US009464259B2

(12) United States Patent
Komp et al.

(10) Patent No.: US 9,464,259 B2
(45) Date of Patent: Oct. 11, 2016

(54) CLEANING COMPOSITION FOR METAL SURFACES

(75) Inventors: Carola Komp, Morfelden-Walldorf (DE); Eckart Schonfelder, Idstein (DE)

(73) Assignee: Chemetall GmbH, Frankfurt am Main (DE)

( * ) Notice: Subject to any disclaimer, the term of this patent is extended or adjusted under 35 U.S.C. 154(b) by 0 days.

(21) Appl. No.: 12/681,206

(22) PCT Filed: Sep. 30, 2008

(86) PCT No.: PCT/EP2008/063089

§ 371 (c)(1),
(2), (4) Date: Apr. 1, 2010

(87) PCT Pub. No.: WO2009/050035

PCT Pub. Date: Apr. 23, 2009

(65) Prior Publication Data

US 2010/0222248 A1 Sep. 2, 2010

(30) Foreign Application Priority Data

Oct. 15, 2007 (DE) ..... 10 2007 000 501

(51) Int. Cl.

| | |
|---|---|
| ***C11D 1/72*** | (2006.01) |
| ***C11D 1/835*** | (2006.01) |
| ***C11D 11/00*** | (2006.01) |
| ***C23C 22/78*** | (2006.01) |
| ***C23G 1/14*** | (2006.01) |
| *C11D 1/62* | (2006.01) |

(52) U.S. Cl.

CPC ..... *C11D 1/721* (2013.01); *C11D 1/835* (2013.01); *C11D 11/0029* (2013.01); *C23C 22/78* (2013.01); *C23G 1/14* (2013.01); *C11D 1/62* (2013.01)

(58) Field of Classification Search

CPC ..... C23G 1/06; C23G 1/065
USPC ..... 510/218, 245, 254
See application file for complete search history.

(56) References Cited

U.S. PATENT DOCUMENTS

| | | | | |
|---|---|---|---|---|
| 3,444,242 | A * | 5/1969 | Brunelle et al. | 568/607 |
| 4,069,066 | A * | 1/1978 | Hindle | C11D 1/62 134/42 |
| 4,093,663 | A * | 6/1978 | Harris et al. | 568/18 |
| 4,149,978 | A * | 4/1979 | Goffinet | C11D 1/62 134/42 |
| 4,443,363 | A * | 4/1984 | Klinger et al. | 510/174 |
| 4,609,488 | A * | 9/1986 | Geke et al. | 210/708 |
| 5,308,401 | A * | 5/1994 | Geke et al. | 134/2 |
| 5,614,027 | A * | 3/1997 | Dunn et al. | 134/2 |
| 5,650,385 | A * | 7/1997 | Dunn et al. | 510/245 |
| 5,712,236 | A * | 1/1998 | Bolkan et al. | 510/259 |
| 5,736,495 | A * | 4/1998 | Bolkan et al. | 510/202 |
| 5,863,881 | A * | 1/1999 | Vlasblom | 510/365 |
| 5,935,920 | A * | 8/1999 | Geke et al. | 510/245 |
| 5,998,352 | A * | 12/1999 | Vlasblom | 510/365 |
| 6,066,606 | A * | 5/2000 | Lu et al. | 510/101 |
| 6,124,253 | A * | 9/2000 | Vinci et al. | 510/254 |
| 6,310,263 | B1 * | 10/2001 | Vlasblom | 585/1 |
| 6,489,278 | B1 * | 12/2002 | Lentsch et al. | 510/218 |
| 2005/0079992 | A1 * | 4/2005 | Smith | 510/506 |
| 2007/0105916 | A1 * | 5/2007 | Pollard | C07D 213/20 514/358 |
| 2007/0270323 | A1 * | 11/2007 | Stedry et al. | 510/201 |
| 2010/0068392 | A1 * | 3/2010 | Bauerochse et al. | 427/327 |

FOREIGN PATENT DOCUMENTS

| | | | |
|---|---|---|---|
| CA | 2 443 645 | A1 | 10/2002 |
| DE | 2556527 | A1 | 6/1977 |
| DE | 3247431 | A1 | 6/1984 |
| DE | 3315951 | A1 | 11/1984 |
| DE | 4014859 | A1 | 11/1991 |
| DE | 102006018216 | | 10/2007 |
| EP | 0 054 895 | A1 | 6/1982 |
| WO | WO-9826034 | A1 | 6/1998 |

OTHER PUBLICATIONS

Tyagi et al. J.Oleo Sci 57, (4) 197-215 (2008).*

* cited by examiner

*Primary Examiner* — Nicole M Buie-Hatcher
*Assistant Examiner* — M. Reza Asdjodi
(74) *Attorney, Agent, or Firm* — Jeremy J. Kliebert

(57) ABSTRACT

The invention relates to an aqueous alkaline cleaning composition for cleaning metal surfaces, containing at least one non-ionic surfactant having demulsifying action and based on ethoxylated alkyl alcohols having one or two alkyl groups, each comprising an average of 7.5 to 16.5 carbon atoms, and an average of 5.5 to 18.5 EO groups per alkyl group, and comprising an end group closure or two end group closures, of which at least one end group closure is an isopropyl, isobutyl, tertiary butyl and/or benzyl group, wherein the surfactant is not propoxylated.

19 Claims, No Drawings

CLEANING COMPOSITION FOR METAL SURFACES

RELATED APPLICATIONS

This application is a §371 application from PCT/EP2008/063089 filed Sep. 30, 2008, which claims priority from German Patent Application No. 10 2007 000 501.8 filed Oct. 15, 2007, each of which is herein incorporated by reference in its entirety.

The invention relates to an aqueous alkaline cleaner-composition for metallic surfaces, containing at least one non-ionic surfactant in accordance with the invention acting in a demulsifying manner, that can be used in order to bring about in a demulsifying manner with the addition of at least one cationic organic compound aqueous, alkaline, surfactant-containing bath solutions (=cleaning baths, baths), contaminated, if applicable, with non-polar organic contaminants, such as, for example, oil(s), and/or other mainly or completely organic contaminants, such as, for example, fat(s), soap(s) and/or a further metal-processing aid or aids, such as, for example, drawing aids, including anionic organic compounds and particle dirt, and to free the cleaner-composition extensively or completely of these contaminants. The invention also relates to a correspondingly contaminated bath which an aqueous alkaline cleaner-composition containing at least one non-ionic surfactant in accordance with the invention that acts in a demulsifying manner and also to a correspondingly more highly concentrated concentrate for the preparation of an aqueous alkaline cleaner-composition inter alia by dilution with water.

The cleaning method for this cleaner-composition can in this case serve in particular as a primary step either prior to the pre-treatment of metallic surfaces of substrates prior to lacquering, prior to the treatment or passivation of metallic surfaces, such as, for example, strips or parts, or prior to cleaning with an industrial washing system or as an intermediate cleaning stage, for example prior to gearbox- or motor-manufacture.

Frequently, the cleaning baths for cleaning metallic objects that are to remove the contaminants, in particular from metal-processing and from corrosion-protection, from the metallic surfaces of metallic objects are initially operated in a demulsifying state. Frequently, however, even after some time the demulsifying state of the bath passes over into an emulsifying state, and often in this connection the cleaning power will have dropped continuously. Depending on the throughput and degree of contamination and also if there is a high entry of oil and further contaminants, such a state can set in after a period of say one day to say 8 weeks. The questions that are then asked are in what way the cleaner-bath can be returned to a state of high cleaning power and what outlay is to be incurred for this for maintenance of the bath. Maintenance of the bath in this connection means: 1. if applicable, analysis of bath composition, pH-value and/or alkalinity; 2. if applicable, supplementing the bath in particular with surfactant(s) and/or builder(s); 3. removal of oil and other contaminants, such as, for example, particle dirt, from the bath; and 4. if applicable, supplementing with water. For, despite the addition of larger quantities of demulsifying surfactants, frequently the demulsifying state of the bath could no longer be established.

In such cases, in particular an increased content of emulsifiers, corrosion-inhibitors, such as, for example, petroleum sulphonates and/or drawing aids, seems to have a disturbing effect as a contaminant in the bath. The high contents of anionic organic compounds in the greatly contaminated cleaner-bath, in particular of anionically acting surfactants, as a result of their like negative charges on the surfaces of the oil droplets, prevent the attraction of the oil drops that, are distributed in the bath to each other. They thus prevent, the coalescence of oil droplets to form larger oil droplets and thus also the demulsifying effect for the formation of larger droplets and for the separation of oil which could then, if applicable, even build up at the bath surface, where it could easily be removed.

Simple alternatives to solve, diminish or avoid this problem are cleaning processes with a constant overflow in which corresponding quantities of bath solution are continuously disposed of, or cleaning processes in which there is a comparatively long run until there is an increased or a high degree of contamination and in which then the whole bath solution within the course of cleaning and bath-maintenance is replaced by new bath solution. Both alternatives are expensive.

The greatly contaminated cleaning baths often have an oil content in the range from 1 to 6 or even 1 to 30 g/l (per liter bath solution) including the further contaminants, a content of fats, soaps and further anionic organic compounds in the range from 0.3 to 3.5 g/l, and a content of surfactants often of the order of magnitude of say 1 g/l.

Such greatly contaminated cleaning baths frequently have high contents of oils and further contaminants including various kinds of surfactants: with a total content of organic substances in the bath of, for example, approximately 10 g/l, possibly approximately 6 g/l are oils, approximately 3 g/l fats and soaps and also approximately 0.5 to 2 g/l surfactants, of which, however, often only contents in the range from say 30 to 70% by weight are non-ionic surfactants that are required for cleaning and often even say 0.3 g/l are emulsifiers from the contaminant, in which case contained in the fats, soaps and emulsifiers there are approximately 1.5 to 3 g/l so-called anionic organic compounds which are added in part, for example, to the corrosion-inhibitors and lubricants and also hydrolyze from, fats by reaction in the alkaline medium and form anionic organic compounds. In particular, anionic organic compounds, such as inter alia anionically acting surfactants, often occur in contaminants. In addition, a cleaner-framework with approximately 3 to 50 g/l builder(s) is often contained therein.

In the automobile industry in this connection often in order to remove oil and further contaminants from the cleaning zone, located in a pre-treatment system upstream of a phosphating zone, costly membrane-filtration systems that are expensive to clean are also frequently used in order to enable the cleaner-bath to be cleansed continuously as far as possible and to guarantee a constantly high level, of cleaning power as far as possible.

When cleaning in particular metallic surfaces, such as, for example, car bodies or car-body elements prior to phosphating and prior to the lacquering that follows this, for many years attempts have been made to adjust a bath so that it is stable for a longer period, of time despite the entry of oil and further non-polar organic contaminants. All or many of these contaminants derive from means for transient (temporary) corrosion-protection, from the processing and/or the treatment of the metallic surfaces. On account of the often continuous entry of oil and further non-polar organic contaminants into the cleaner-bath, bath-maintenance is necessary from time to time or continuously in order to remove the oils and the further non-polar organic contaminants and to preserve or re-set a high level of cleaning power.

Used industrially today as bath-maintaining processes as part of cleaning processes are:

1. Discontinuous bath-maintaining processes without higher investment for bath-maintenance, in particular in the case of smaller systems;
2. Continuous bath-maintaining processes with an oil-separator, such as, for example, a settling container, de-oiler, coalescence-separator, separator, a centrifuge or similar devices for oil-separation (in particular membrane-free processes with gravitational force and differences in density as a parting principle) to separate and remove oils and further non-polar organic contaminants from the cleaner-bath and its circuit, in which case the contaminants of the cleaner-bath continuously accumulate in the oil-separator and can be removed there, if required;
3. Continuous bath-maintaining processes with a costly membrane-filtration process that is expensive to maintain, with a membrane-filtration system (for example an ultrafiltration or microfiltration system). The membranes of these systems allow the inorganic constituents, a portion of the surfactants and water to pass through, and largely hold back the non-polar organic constituents.

In the case of a discontinuous process without bath-maintaining measures to improve and/or preserve the bath, in many cases a system is in each case started in the clean state and used for so long until increased or high contamination with oils and further non-polar organic contaminants has occurred. In this case, the cleaning power of the cleaner-bath drops continuously. Finally, the contaminated bath is then as a rule disposed of. A new batch of the bath is required in order to be able to use the bath again with a high level of cleaning power.

In the case of a continuous bath-maintaining process, in many cases a bath is started once in the clean state and used further as far as possible permanently, the contaminant with oils and further non-polar organic contaminants being removed continuously or time and again at short intervals to a certain proportion, and the substances that are required for cleaning being supplemented continuously or time and again at short intervals in order to operate the cleaner-bath with the highest possible cleaning power and under the most uniform conditions possible. In this case, however, the surfaces of the membranes of membrane-filtration processes can easily become coated with fat, particle dirt and further contaminants, and the pore channels of the membranes clog so that the latter then have to be cleaned, for example by rinsing. Each membrane-filtration process is exceptionally personnel- and cost-intensive.

The cleaner-bath is used in particular as a primary step prior to the pre-treatment of surfaces of substrates prior to lacquering or prior to the treatment or passivation of the metallic surfaces or prior to the use of an industrial washing system or for intermediate cleaning. A cleaner-bath typically contains in addition to water at least one surfactant and, if applicable, however, also at least one substance (builder) of the cleaner-framework, such as, for example, in each case at least one borate, carbonate, hydroxide, phosphate, silicate, if applicable, at least one organic solvent and/or, if applicable, at least one additive, such as, for example, at least one defoaming agent and also, if applicable, at least one imported oil and, if applicable, further contaminants.

As surfactant(s) typically at least one non-ionic surfactant is added, to the aqueous cleaner-bath. On account of the contamination of the metallic surfaces, however, often anionic organic compounds, oils and/or often further non-polar organic contaminants, in particular fats and/or soaps, are imported. The cleaner-bath is preferably kept constantly in a demulsifying state. The demulsifying state of the cleaner-bath is achieved by means of the addition or by means of the content of at least, one non-ionic surfactant in accordance with the invention. Preferably no anionic and/or amphoteric surfactants are added to the demulsifying cleaner-bath, because it is not possible to clean in a demulsifying manner with these surfactants.

In addition, in particular builders of the cleaner-framework, pickling-inhibitors, corrosion-inhibitors and, if applicable, further additives can occur in the cleaner-bath in addition to water. Usually, in the more heavily industrialized countries no significant quantities of organic, solvents are contained in the contaminant, nor in the fresh bath.

DE 102006018216 A1 teaches processes for demulsifying cleaning and mentions a plurality of surfactants and cationic organic polymers which are basically possible for the development of a demulsifying cleaning process. In this connection, certain classes of non-ionic or cationic surfactants with their basic composition are specified as demulsifying surfactants. DE 102006018216 A1 and its associated foreign applications are expressly incorporated in this application, in particular with regard to the cleaning processes and effects.

An object of the invention is to put forward an aqueous cleaner-composition with which a cleaner-bath for contaminated metallic surfaces can be cleaned more easily and/or more cheaply of oil(s), of further non-polar organic contaminants, of particle dirt, of soap(s) and/or of a further metal-processing aid or aids, such as, for example, drawing aids. A further object consists in putting forward an aqueous cleaner-composition with which even when the cleaner-bath is greatly contaminated with anionic organic compounds it is possible to operate in a demulsifying manner.

The object is achieved with an aqueous alkaline cleaner-composition for cleaning metallic surfaces that contains at least one non-ionic surfactant acting in a demulsifying manner and based on ethoxylated alkyl alcohols with one or two alkyl groups with on average in each case 7.5 to 16.5 carbon atoms and with on average 5.5 to 18.5 EO groups per alkyl group and also with one or two end-group closures, of which at least one end-group closure is an isopropyl, isobutyl, tertiary butyl and/or benzyl group, the surfactant not being propoxylated.

The invention is also achieved with a contaminated bath containing an aqueous alkaline cleaner-composition which contains the at least one non-ionic surfactant in accordance with the invention that acts in a demulsifying manner and a contaminant.

The invention is further achieved with an aqueous concentrate for an aqueous alkaline cleaner-composition in which the at least one non-ionic surfactant in accordance with the invention that acts in a demulsifying manner is contained in a concentration that is higher by a factor of 5 to 5000 than in the aqueous alkaline cleaner-composition that can be produced herefrom. Preferably, water of mains-water quality and/or deionized water is used in order to dilute the concentrate. The concentrate is preferably diluted with water by a factor in the range from 50 to 3500, from 100 to 3000 or from 200 to 2500, particularly preferably in the range from 300 to 2000 or from 400 to 1500 or from 500 to 1000. This concentrate is used to prepare an aqueous alkaline cleaner-composition inter alia by dilution with water, yet, if applicable, also by adding further substances, such as, for example, cleaner-framework and/or additives.

It has now been established that the non-ionic surfactants in accordance with the invention that act in a demulsifying manner and are based on ethoxylated alkyl alcohols are exceptionally well suited for an alkaline aqueous cleaner-composition that, acts in a demulsifying manner, with regard to their cleaning power, their demulsifying action and their low tendency to foam, in particular on account of all three properties at the same time.

Even without the presence of at least one cationic organic compound the at least one non-ionic surfactant in accordance with the invention that acts in a demulsifying manner acts in a demulsifying manner. The more strongly one of these surfactants acts in a demulsifying manner, the better suited it is for the demulsifying cleaner-bath. However, it is also advisable for it likewise to have a high cleaning power and a low tendency to foam.

In particular, the non-ionic surfactant in accordance with the invention that acts in a demulsifying manner has a benzyl group in at least one end-group closure. In particular it has just one end-group closure. The alkyl groups can be, independently of one another, linear or branched; independently of one another, they are saturated or unsaturated. It is possible for a plurality of non-ionic surfactants in accordance with the invention that act in a demulsifying manner and that have a clearly different molecular structure in accordance with the main claim to be present in the cleaner-composition in accordance with the invention.

The non-ionic surfactant in accordance with the invention that acts in a demulsifying manner is preferably at least one ethoxylated alkyl alcohol with one or two alkyl groups with on average in each case 7.5 to 14.5 carbon atoms and in particular with on average 5.5 to 18.5 EO groups per alkyl group and also with one or two end-group closures, of which at least one end-group closure is an isopropyl, isobutyl, tertiary butyl and/or benzyl group, in particular at least one benzyl group is an end-group closure, the surfactant not being propoxylated. In particular, it has only one alkyl group. The alkyl groups can be, independently of one another, linear or branched; independently of one another, they are saturated or unsaturated.

In a particularly preferred way the non-ionic surfactant in accordance with the invention that acts in a demulsifying manner is at least one ethoxylated alkyl alcohol with one or two alkyl groups with on average in each case 7.5 to 12.5 carbon atoms and in particular with on average 7.5 to 14.5 EO groups per alkyl group and also with one or two end-group closures, of which at least one end-group closure is an isopropyl, isobutyl, tertiary butyl and/or benzyl group, in particular in each case at least one tertiary butyl and/or benzyl group, in particular at least one benzyl group is an end-group closure, the surfactant not being propoxylated. In particular, it has only one alkyl group. The alkyl groups can be, independently of one another, linear or branched; independently of one another, they are saturated or unsaturated.

In an especially preferred way the non-ionic surfactant in accordance with the invention that acts in a demulsifying manner is at least one ethoxylated alkyl alcohol with one alkyl group with on average 8.5 to 11.5 carbon atoms and in particular with on average 9.5 to 12.5 EO groups per alkyl group and with one benzyl group as an end-group closure, the surfactant not being propoxylated. The alkyl group can be linear or branched; it can be saturated or unsaturated.

The non-ionic surfactants (alkyl alcohols) in accordance with the invention that act in a demulsifying manner can have, independently of one another, one or two branched or unbranched (=linear) alkyl groups which, independently of one another, are saturated or unsaturated. When there are two alkyl groups they are gemini surfactants. Each alkyl group can, if applicable, independently of one another, in each case have one or more aromatic, substituted aromatic, phenolic and/or substituted phenolic groups, with above all amino-, hydroxyl-, carboxyl-, carbonyl- and/or nitro-groups being preferred as substituents. One alkyl group of the at least one surfactant in accordance with the invention that acts in a demulsifying manner preferably contains on average 7.5 to 16.5 carbon atoms, in particular in each case on average 7.5 to 14.5, 8.5 to 12.5 or 8.5 to 11.5 carbon atoms, and on average 5.5 to 18.5 EO groups, in particular on average 6.5 to 16.5, 7.5 to 14.5 or 9.5 to 12.5 EO groups (ethylene-oxide groups), in particular in each case on average 7.5 to 12.5, 8.5 to 11.5 or 9.5 to 10.5 EO groups. The end-group closure can contain for each alkyl group, independently of one another, preferably chlorine, ethyl, methyl, propyl, isopropyl, n-butyl, isobutyl, tertiary butyl, pentyl, isopentyl, hexyl, isohexyl or benzyl, in particular benzyl, tertiary butyl or butyl.

The at least one surfactant that acts in a demulsifying manner can act in a demulsifying manner in an aqueous alkaline cleaner-composition, which, if applicable, is contaminated, with and without contact with at least one cationic organic compound, such as, for example, at least one cationic surfactant and/or at least one cationic organic polymeric compound. The at least one cationic organic compound can react chemically in the cleaner-composition with the at least one non-polar organic compound and/or with the at least one anionic organic compound. These chemical reactions often run very quickly. The co-reactants in this connection mostly form compounds that are difficult to dissolve in water and/or cannot be dissolved in water and in many cases are inactive and which can often build up at the bath surface and, if applicable, at the base of the bath container and/or on its walls. These can be removed from the bath often and comparatively easily. The non-ionic surfactant in accordance with the invention that acts in a demulsifying manner in this connection acts in particular by means of its specific molecular geometry. It thereby has the task of cleaning intensely, foaming as little as possible and thereby acting in a demulsifying manner to the greatest possible extent. On account of its low tendency to foam in the usual applications, it is also suitable for spraying applications.

The cleaner-composition in accordance with the invention can preferably additionally contain at least one further non-ionic surfactant, at least one amphophilic surfactant, at least one cationic surfactant, at least one cationic organic polymer, at least one cleaner-framework (builder), at least one corrosion-inhibitor and/or at least one further additive and also, if applicable, corresponding counterions to the amphophilic surfactants, cationic surfactants and/or cationic polymeric compounds. Preferably no anionic surfactants, no further anionic organic compounds, if applicable with the exception of at least one anionic solubilizer, and/or no non-polar organic compounds are deliberately added to the cleaner-composition in accordance with the invention. In quite a few embodiments it is recommendable not to add any polymeric cationic compounds deliberately. The cleaner-composition in accordance with the invention in certain embodiments preferably contains no cationic polymeric compounds based on polyethylene imine and/or no corrosion-inhibitor.

The cleaner-composition in accordance with the invention can preferably additionally also contain at least one ethoxylated-propoxylated non-ionic surfactant in particular with, a cloud point below 20° C. This non-ionic surfactant can then act as a defoaming agent.

In an especially preferred way the cleaner-composition in accordance with the invention contains at least at times at least one cationic surfactant, and/or at least one cationic organic polymer, in particular at least one quaternary ammonium compound with one or two aromatic and/or substituted aromatic, groups selected from amphophilic compounds of the general formula (I), for the chemical reaction with non-polar organic compounds and/or anionic organic, compounds in particular from contaminants.

The at least one cationic surfactant can preferably be a quaternary ammonium compound with one or two aromatic and/or substituted aromatic groups in the cleaner-composition in accordance with the invention. The at least one cationic surfactant is preferably selected from amphophilic compounds of the general formula (I)

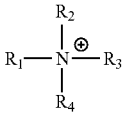

wherein $N^{\oplus}$ represents nitrogen as a quaternary ammonium compound, wherein $R_1$ is an alkyl group—saturated or unsaturated—with an average number of carbon atoms in the range from 8 to 18 carbon atoms with in each case either a linear or branched chain formation, wherein the alkyl group $R_1$ can contain, if applicable, one or more aromatic and/or phenolic groups or can be replaced by them, wherein $R_2$ is hydrogen, $(EO)_x$ (=polyether chain of the formula "—$CH_2$—$CH_2$—O—" with x=1 to 50 units with or without end-group closure, in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure in particular with a methyl, ethyl, propyl, isopropyl, n-butyl, isobutyl, tertiary butyl or benzyl group) or an alkyl group—saturated or unsaturated—with an average number of carbon atoms in the range from 1 to 18 carbon atoms with either a linear or branched chain formation, wherein the alkyl group $R_2$ can contain, if applicable, one or more aromatic and/or phenolic groups or can be replaced by them, wherein $R_3$ and $R_4$ are, independently of one another, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 10 with in each case either a linear or branched chain formation, wherein, if applicable, $R_3$ and/or $R_4$ can contain independently of one another one or more aromatic and/or phenolic groups or can be replaced by them, wherein, if applicable, $R_2$, $R_3$ and/or $R_4$ can contain and/or represent independently of one another one or more groups selected from amino groups, carbonyl groups, ester groups, ether groups, OH groups and nitro groups on at least one of the carbon atoms and/or between the carbon atoms at least of one alkyl group.

In a particularly preferred manner at least one cationic surfactant has one or two benzyl groups.

The at least one cationic organic compound can preferably be present in roughly such a content or at least such a content in the cleaner-composition in accordance with the invention as is necessary for extensive or complete chemical reaction thereof with the non-polar organic compounds and/or anionic organic compounds present in the cleaner-composition.

The cleaner-composition in accordance with the invention preferably has a content of cationic organic compounds in the bath—in particular in the case of discontinuous operation—in a quantity directly prior to the chemical reaction thereof at which the stoichiometric ratio of cationic organic compounds to anionic organic compounds in the bath is kept in the range from 0.1:1 to 10:1.

The contents of the at least one surfactant in accordance with the invention that acts in a demulsifying manner and is based on ethoxylated alkyl alcohols with end-group closure and the contents of the at least one cationic organic compound in the cleaner-composition in accordance with the invention can preferably be selected roughly or at least in such a way that the cleaner-composition operates in the weakly anionic, weakly cationic or charge-neutral range.

It is possible to measure this state by means of Epton titration. The cleaner-composition in accordance with the invention, in particular as a function of its concentration of active ingredients, preferably often lies in a range from −0.005 g/l to +0.025 g/l, from −0.02 g/l to +0.08 g/l or from −0.1 g/l to +0.2 g/l of cationic organic substances. Only with a content of particularly polar substances in the bath is it possible for the values also to lie in a range from −0.1 g/l to +0.4 g/l of cationic organic substances, this probably being the result of the testing method. A more closely observed tolerance than that mentioned here is advantageous.

The Epton two-phase titration is carried out in such a way that the cleaner-composition that is to be tested after dilution with deionized water and after neutralization with control with pH paper is undercoated with dichloromethane and is titrated with a cation-active substance solution as reagent and an indicator mixture based on a cationic dye and an anionic dye whilst stirring intensively. The stirring is interrupted time and again in order to wait for the two phases to separate. With the approach of the end point, the emulsion, which is formed by the vigorous stirring, breaks up more and more easily so that titration is carried out more carefully and in between stirring is effected more and more intensively until the end point is reached. The end point is to be regarded as when the red colour from the dichloromethane phase has completely disappeared and given way to a mostly pale greenish-blue or colourless or violet colouring. The consumption of the reagents can then be converted to the molar content of anionic constituents.

When operating in an industrial system it is difficult to meet and keep the charge-neutral state of the cleaner-composition. The cleaner-composition will therefore often only be able to operate in a weakly anionic or weakly cationic manner. These ranges and the charge-neutral point in between are, however, the most favourable operating ranges. In addition, it is possible to operate in such a way with regard to the metering of the at least one cationic compound to the cleaner-composition in accordance with the invention that in particular only when or in particular even when a certain degree of contamination of non-polar organic compounds and/or anionic organic compounds has set in in the cleaner-composition, that is, a certain quantity of non-polar organic compounds and/or anionic organic compounds has built up in the cleaner-composition, is a quantity of at least one cationic compound added to the contaminated cleaner-composition. This added quantity of at least one cationic compound or the quantity of at least one cationic compound that is attained subsequently in the cleaner-composition can then preferably lie in the order of magnitude that the cleaner-composition operates in the weakly anionic range, at the charge-neutral point or in the weakly cationic range (=demulsifying operation). This makes it possible for the non-polar organic compounds and/or the anionic organic compounds in the cleaner-composition to react chemically extensively or completely with the at least one cationic compound and to form compounds that are difficult to dissolve in water and/or cannot be dissolved in water. These compounds that are difficult to dissolve in water and/or cannot be dissolved in water can as a rule be removed from the bath comparatively easily. They can, for example, be extensively or completely removed, for example scooped off, by way of the removal of contaminants, such as, for example, oil and/or other dirt. The removal of these non-polar organic compounds and/or anionic organic compounds by way of the removal of their reaction products serves to keep the cleaner-bath permanently ready for operation, even despite further entry of non-polar organic compounds and/or anionic organic compounds, without it coming to special expensive measures to clean or replace the cleaner-bath in the long run or permanently.

The at least one cationic organic compound is preferably first added (anew) to the cleaner-composition when a certain minimum quantity of non-polar organic compounds and/or anionic organic compounds has entered the cleaner-bath and is therefore contained in the cleaner-composition. In the meantime, that is, before the first addition or from one addition to the following addition of in each case at least one cationic organic compound to the cleaner-composition, the content of the at least one cationic organic compound in the cleaner-composition is preferably temporarily in each case at zero, very low or comparatively low.

The cleaner-composition in accordance with the invention is used in particular a) prior to treatment, prior to passivation and/or for corrosion-protection of the metallic surfaces with an aqueous surfactant-containing bath, b) prior to the so-called pre-treatment of metallic surfaces of substrates, for example prior to lacquering, for example with a pre-treatment composition (conversion treatment) such as, for example, by phosphating, prior to joining, prior to reshaping and/or prior to lacquering, c) prior to the use of an industrial washing system, and/or d) as intermediate cleaning, for example prior to gearbox- or motor-manufacture.

In the following, no distinction is made between bath, bath solution and cleaner-bath and so there is mostly talk of the "bath". In this connection, these terms also include, by way of example, a solution that is applied by spraying, for example.

The aqueous alkaline surfactant-containing bath that is used for alkaline cleaning preferably has a pH value in the range from pH 7 to 14, in particular in the range from pH 8 to 13 or from pH 8 to 12, especially in the range from pH 9 to 11.

The oils that are used in practice today are mixtures that are of a very complicated composition and have a plurality of differing substances in addition to the constituents of the base oil. An oil can therefore in many cases contain say 50 different substances. The term "oil" for the purposes of this application in this connection on the one hand is to signify an "oil-containing composition" which is a composition based on many compounds with a substantially oil-containing character that contains at least one base oil and typically also at least one anionic organic compound, such as, for example, at least one compound based on petroleum sulphonate. On the other hand, the term "oil" for the purposes of this application also signifies at least one base oil from this oil-containing composition. In the event of the contamination of the bath, in particular the at least one base oil, yet also fat(s), soap(s), the at least one (further) anionic organic compound and/or quite a few further substances added to the base oil and also the reaction products thereof in particular with water constitute a disturbance, because the cleaning power of the bath is reduced thereby or even brought to a standstill. The at least one anionic organic compound in particular thereby acts on the state of the bath.

As oils which, if applicable, contribute to the contamination of the bath there often come into consideration naphthenic and/or aliphatic oils. These oils are best called processing oils. They are possibly also termed and/or used as, for example, quenching oils, hardening oils, honing oils, anti-corrosive oils, cooling lubricating emulsions, cooling lubricating oils, cutting oils and/or reshaping oils.

Although the content of oils in the bath operated in accordance with the invention can basically also assume high values, such as, for example 1 g/l, 5 g/l or 10 g/l, in the case of the method in accordance with the invention the content either of oil(s) (in the narrow sense) or of oil-containing composition (=oil(s) including further contaminants which, if applicable, can derive in part from the constituents of the oils, but also in part from chemical reactions of the constituents of the oil-containing composition) in the bath, in particular during continuous operation, is preferably kept at no more than 3 g/l, in particular at no more than 2.5, 2, 1.5, 1, 0.8, 0.6, 0.4, 0.2 or 0.1 g/l or preferably in the range from 0.01 to 3 g/l, particularly preferably in the range from 0.02 to 2.2 g/l or from 0.03 to 1.5 g/l, especially preferably in the range from 0.05 to 1 g/l. In this connection, samples are taken from the middle of the bath, in which only small portions or no portions at all of the oil-containing phase can be found on the bath-surface, in particular in a demulsifying state. In the case of the method in accordance with the invention it is particularly preferred if the content of the cleaner-bath in terms of oil(s) including further contaminants is kept in the range from 0.03 to 2 or from 0.05 to 1 g/l, and the content of surfactants is kept in the range from 0.05 to 0.07 g/l or from 0.1 to 1.6 g/l, this being dependent in particular upon the system and the mode of operation. A base oil need not, however, always occur as the contaminant, in particular if the contaminants are residues of a deep-drawing fat and/or a soap for cold-forming.

In particular, oil(s), fat(s), soap(s), metal-processing aids, such as, for example, drawing aids, and/or, if applicable, even particle dirt, which like the oil(s) are derived, in particular from metal-processing and/or from means for corrosion-protection, can occur as non-polar organic contaminants. Particle dirt can in this connection occur as a mixture based substantially on dust, abraded portions, for example from metallic material(s), rubber, plastic(s) and/or abrasive(s), metallic chips, welding residues and/or welding beads.

The anionic organic compounds predominantly belong to the polar organic contaminants and as a rule in each case carry at least one carboxyl group, hydroxycarboxyl group, phosphate group, phosphonate group, sulphonate group and/or sulphate group. In the alkaline medium these compounds can as a rule easily be dissolved in water. They are amphiphilic, anionic organic compounds, such as, for example, anionic surfactants, petroleum sulphonate(s), aminocarboxylic acid(s), soap(s) and/or derivatives thereof. They frequently act as corrosion-inhibitors and/or as lubricants. They are frequently added to the oils as additives. The substances which are added to the oils as additives, such as, for example, as corrosion-inhibitors, reshaping aids, formulation additives, biocides etc., can in each case independently of one another be polar or non-polar, uncharged or anionically charged. The main proportion of these additives, however, mostly also belongs to the anionic organic compounds. The other substances of these additives, however, are mostly present in comparatively small quantities. Often they do not or do not substantially constitute a disturbance.

Fats and fatty oils can often hydrolyze in aqueous alkaline media and thereby form soaps which can also number among the anionic organic compounds, such as, for example, those on the basis of caprylic acid, lauric acid, oleic acid, palmitic acid and/or stearic acid, in particular on the basis of alkali caprylates, alkali laurates, alkali oleates, alkali palmitates and/or alkali stearates, such as, for example, sodium stearate and/or potassium stearate or in particular corresponding further carboxylates. Compounds that are hydrolyzed in water (soaps) which often have surfactant-like properties, which can be polar and/or non-polar (next to one another), can also be formed from fats and fatty oils.

The contaminant usually contains at least one oil, in many cases also at least one anionic organic compound. When oil(s) with very many additives is/are used, in practice often a limitation of the demulsifying operation of the bath occurs, because the content of anionic organic compounds, taken up in the bath during cleaning, is too high. The demulsifying power of the bath that is present initially or previously decreases with increasing contamination, for example as a result of anionic organic compound(s), and can easily become exhausted if the contents of anionic organic compounds become too great, since the anionic organic compounds can build up in the bath and limit the cleaning power of the bath to an ever greater extent. A demulsifying surfactant that acts in a demulsifying manner initially can then lose its demulsifying effect in the bath. A demulsifying surfactant has a demulsifying effect, under the usual conditions of a cleaner-bath, but in particular as a result of the entry of and/or the reaction to anionic organic compounds can lose its demulsifying effect.

In particular, the method in accordance with the invention is provided for cleaning methods and for baths with contaminants that have contents of anionic organic compounds, in particular contents of anionic organic compounds in the range from 0.2 g/l to very high contents, such as, for example, of the order of magnitude of say 100 g/l. In many cases the contents lie in the range from 0.25 to 60 g/l or in the range from 0.3 to 40 g/l, particularly frequently in the range from 0.35 to 30 g/l or in the range from 0.4 to 20 g/l, especially frequently in the range from 0.45 to 15 g/l, in the range from 0.5 to 10 g/l, or in the range from 0.55 to 5 g/l. Nevertheless, in accordance with the invention they can be operated simply and with good demulsification if the corresponding contents are contained in the bath and/or corresponding additives are added to it.

In many cases it is advantageous or even necessary to limit the content of anionic organic compounds in a bath to certain maximum values, because otherwise the demulsification of oil is diminished or prevented so that the content of oil and further contaminants in the bath rises and the cleaning power of the bath decreases. The content of anionic organic compounds is limited in many variant embodiments to values of as far as possible no more than, for example, 50 g/l, such as, for example, when a centrifugal system is used to centrifuge the contaminant from the surface of the bath. In an industrial system, for example for greatly reshaped parts prior to further treatment, in particular for corrosion-protection of the metallic surfaces, prior to passivation, prior to pre-treatment, for example with a composition for conversion-treatment, such as, for example, phosphating, prior to joining and/or prior to reshaping, it can be recommended, if applicable, to allow as far as possible no more than, for example, 5 g/l of anionic organic compounds in an aqueous, alkaline, surfactant-containing bath. In a car-body-cleaning system in the automobile industry it can be necessary, if applicable, to allow no more than, for example, 1 g/l of anionic organic compounds in the cleaner-bath in order to be able to operate the system continuously and without special bath-maintaining measures.

For the content of anionic organic compounds in a cleaner-bath can already have an effect upon the demulsifying action of the bath in very small quantities in quite a few systems on account of certain types of oil(s) that are likewise contained in the contaminant: for example, often say 0.05 or say 0.1 g/l of anionic organic compounds already suffice in order to reduce or even completely prevent the demulsifying effect, this depending inter alia as well, upon the type of substances present.

When cleaning the metallic surfaces from oil-containing compositions, the size of the oil droplets primarily cleaned away is usually very small, that is, in many cases of a diameter say in the range from 0.5 to 5 or even to 50 μm. A large interface between oil and water, however, is generally unfavourable energetically so that the chemical system tends towards a situation where a plurality of small oil droplets flow together to form at least one larger one. This process is also termed coalescence. It stops, however, when the oil droplets attain a radius of curvature that is predetermined by the geometry of the surfactant or the surfactant mixtures used. In this connection, it is recommended in many variant embodiments that, by way of the selection of the surfactants, their contents and their mixture, a certain radius of curvature of the oil droplets as a radius of curvature that is largely possible in baths be adjusted by coating the oil droplets. In this case, it is possible to optimize the method in accordance with the invention in the fine range. This radius of curvature is preferably adjusted in quite a few variant embodiments in such a way that the oil is precisely not yet demulsified in a bath in motion and that an oil-containing phase has therefore precisely not yet built up or not yet built up to a greater extent on the surface of the bath, yet separates spontaneously in a bath at rest, such as, for example, in a separating container (oil-separator), and accumulates on the surface of the bath as an oil-containing phase and as a phase that often also contains contaminants other than oil.

It has now been established that as a result of the renewed addition, if applicable, of at least one cationic organic compound which in particular can also be at least one surfactant and/or at least one cationic polymer, such as, for example, at least one cationic polyelectrolyte, it is possible to maintain the demulsifying state. In this connection, what is termed the demulsifying state is also a state of the bath in which the constituents of the oil-containing composition, that is, in particular oil(s) and anionic organic compound(s), separate and in particular also accumulate on the bath surface as an oil-containing phase and can be removed. In this way, the bath can easily be cleaned by scooping off the contaminants from the bath surface.

The demulsification is brought about by virtue of the fact that small oil droplets run together and produce larger oil drops. If the oil drops are large enough, these can float up to the bath surface and accumulate there further. This process can be impaired or even suppressed by contents of emulsifiers and/or anionic organic compounds.

The demulsifying state of a bath can be identified by virtue of the fact that with diminished or a lack of bath movement an oil-containing phase separates spontaneously and, if applicable, builds up on the surface of the bath and/or in rare cases at the base of the bath container as an oil-containing phase, whilst with certain or strong movement of the cleaner-composition no oil-containing phase separates. Preferably no emulsifier or in individual variant embodiments only a small quantity of at least one emulsifier of up to 0.5 g/l, preferably up to 0.2 g/l, particularly preferably up to 0.05 g/l, is deliberately added to the bath, in particular if the bath shows little or no bath movement. At least, one emulsifier may possibly be imported as well by the contaminant. The demulsifying surfactants and the cationic organic compounds act as demulsifiers. The non-ionic surfactants that are used for cleaning in this connection likewise often act as demulsifiers. They act as demulsifiers in particular when the arrangement of the surfactant molecules on the oil droplet results in a curvature that is not too great. The droplet size of the oil droplets then illustrates the state of the bath: the smaller the oil droplets are, the more intensely emulsifying the bath is, and the larger the oil droplets are, the more intensely demulsifying the bath is.

The process of coalescence is diminished or even suppressed, by the presence of anionic organic compounds in the bath, since the anionic organic compounds absorbed on the oil droplets charge the oil droplets in like manner, this in turn resulting in repulsion of the oil droplets one from the other. On account of the addition, for example, of cationic organic compounds, this anionic charging can be neutralized in part or even completely so that a demulsifying state continues to exist and the coalescing of the oil droplets can proceed.

In practice, for many variant embodiments this means that the content of anionic organic compounds in the bath solution is determined, for example, by Epton titration and that corresponding quantities of at least one cationic organic compound are added to the bath. The quantities of cationic organic compounds contained in total in the bath can therefore preferably be selected in such a way that the demulsifying state is achieved again and/or is continued to the desired, extent. In this connection, in quite a few variant embodiments it can be advantageous if a state that is precisely demulsifying, yet a state that is not yet intensely demulsifying is adjusted.

Preferably at least one demulsifying surfactant which is contained in the bath and/or is added to the bath is and/or comes to be selected from non-ionic surfactants, in particular from the non-ionic surfactants in accordance with the invention that act in a demulsifying manner and/or from cationic surfactants that act in a demulsifying manner. Usually, all the cationic surfactants can act in a demulsifying manner by interaction with at least one anionic organic compound. In addition, many non-ionic surfactants act in a demulsifying manner in particular on account of their molecular geometry, polarity of the whole molecule and/or the surfactant mixture. The at least one demulsifying surfactant is then used to reduce the surface tension, to clean, to demulsify, to adjust the emulsifying or demulsifying properties and/or to diminish the tendency to foam. The at least one demulsifying, in particular cationic and/or non-ionic surfactant acts for so long also as a demulsifying surfactant as long as the conditions of use are adjusted in such a way that it is in a demulsifying state that is substantially dependent upon the chemical composition, upon the type and quantity of the contaminants, upon the salt content and upon the temperature of the bath and also upon the type and power of the bath-circulation or the pumps.

Both the contents of demulsifying surfactants in total and also the contents of the non-ionic surfactants in accordance with the invention that act in a demulsifying manner in the aqueous alkaline cleaner-composition preferably lie in the range from 0.01 to 60 g/l or from 0.03 to 30 g/l, particularly preferably in the range from 0.05 to 20 g/l, especially preferably in the range from 0.06 to 15 g/l or from 0.1 to 10 g/l. They then often lie in the range from 0.5 to 8 g/l or from 1 to 6.5 g/l or from 2 to 5 g/l. In this connection, mostly contents of demulsifying surfactants and contents of non-ionic surfactants in accordance with the invention that act in a demulsifying manner are used in spraying processes in the range from 0.1 to 5 g/l, in dipping processes in the range from 0.2 to 10 g/l, usually irrespective of whether the processes are continuous or discontinuous. In a number of embodiments it is possible to keep the surfactant contents low so that the non-ionic surfactants in accordance with the invention that act in a demulsifying manner in the aqueous alkaline cleaner-composition preferably lie in the range from 0.01 to 6 g/l or from 0.03 to 3 g/l, particularly preferably in the range from 0.05 to 2 g/l, especially preferably in the range from 0.08 to 1.5 g/l, from 0.1 to 1 g/l or from 0.12 to 0.7 g/l.

The contents of cationic surfactants and/or cationic organic polymers from the time of their addition to the contaminated aqueous alkaline cleaner-composition and before they react chemically preferably lie in the range from 0.1 to 100 g/l or from 0.3 to 60 g/l, particularly preferably in the range from 0.5 to 40 g/l, especially preferably in the range from 0.8 to 20 g/l or from 1 to 10 g/l. They then often lie in the range from 2 to 8 g/l or from 3 to 6 g/l. In a number of embodiments it is possible to keep these contents low so that the non-ionic surfactants in accordance with the invention that act in a demulsifying manner in the aqueous alkaline cleaner-composition preferably lie in the range from 0.01 to 6 g/l or from 0.03 to 3 g/l, particularly preferably in the range from 0.05 to 2 g/l, especially preferably in the range from 0.08 to 1.5 g/l, from 0.1 to 1 g/l or from 0.12 to 0.7 g/l.

The contents of cationic surfactants and/or cationic organic polymers preferably after the chemical reaction of the cationic surfactants and/or the cationic organic polymers with the contaminants in the aqueous alkaline cleaner-composition are preferably zero with trace contents or in the range from 0.001 to 5 g/l or from 0.003 to 3 g/l, particularly preferably in the range from 0.005 to 2 g/l or from 0.01 to 1.5 g/l, especially preferably in the range from 0.05 to 1 g/l or from 0.1 to 0.5 g/l. In many embodiments, the contents of cationic surfactants and/or cationic organic polymers are kept in this order of magnitude for a longer time, preferably until the next addition of cationic surfactants and/or cationic organic polymers after more intense contamination, in this order of magnitude in the aqueous alkaline cleaner-composition.

In the case of the method in accordance with the invention at least one demulsifying surfactant is preferably selected or comes to be selected from the group of non-ionic surfactants and in particular is at least one based on ethoxylated alkyl alcohols, ethoxylated-propoxylated alkyl alcohols, ethoxylated alkyl alcohols with one end-group closure or with two end-group closures and ethoxylated-propoxylated alkyl alcohols with one end-group closure or with two end-group closures, wherein the alkyl group of the alkyl alcohols—saturated or unsaturated, branched or unbranched—can, if applicable, have an average number of carbon atoms in the range from 6 to 22 carbon atoms with in each case either a linear or branched chain formation, wherein the alkyl group can, if applicable, have one or more aromatic and/or phenolic groups, wherein the ethylene-oxide chain can, if applicable, have in each case on average 2 to 30 ethylene-oxide units, wherein the propylene-oxide chain can, if applicable, have in each case on average 1 to 25 propylene-oxide units, and wherein, if applicable, can occur with one end-group closure or with two end-group closures in particular with one alkyl group—saturated or unsaturated, branched or unbranched—with on average 1 to 8 carbon atoms.

In this connection, at least one demulsifying surfactant can be selected in particular from the group of non-ionic surfactants based on ethoxylated alkyl phenols, ethoxylated-propoxylated alkyl phenols, ethoxylated alkyl phenols with one end-group closure and ethoxylated-propoxylated alkyl phenols with one end-group closure, wherein the alkyl group of the alkyl phenols—saturated or unsaturated, branched or unbranched—has an average number of carbon atoms in the range from 4 to 18 carbon atoms, wherein the ethylene-oxide chain can, if applicable, have in each case on average 2 to 30 ethylene-oxide units, wherein the propylene-oxide chain can, if applicable, have in each case on average 1 to 25 propylene-oxide units, and wherein, if applicable, one end-group closure can occur in particular with one alkyl group—saturated or unsaturated, branched or unbranched—with on average 1 to 8 carbon atoms.

In this connection, at least one demulsifying surfactant can be selected in particular from the group of non-ionic surfactants based on ethoxylated alkylamines is contained in the bath, the alkyl group of which—saturated or unsaturated—has an average number of carbon atoms in the range from 6 to 22 with in each case a linear or branched chain formation and the polyethylene-oxide chain of which has an average number of ethylene-oxide units in the range from 3 to 30 and/or the average number of propylene-oxide units of which lies in the range from 1 to 25.

In this connection, at least one demulsifying surfactant can be selected in particular from the group of non-ionic surfactants based on surfactants of ethoxylated or ethoxylated-propoxylated alkane acids, the alkyl group of which—saturated, unsaturated or cyclic—has an average number of carbon atoms in the range from 6 to 22 with in each case linear or branched chain formation and the polyethylene-oxide chain of which has an average number of ethylene-oxide units in the range from 2 to 30 and/or the average number of propylene-oxide units of which lies in the range from 1 to 25.

In this connection, at least one demulsifying surfactant can be selected in particular from the group of non-ionic surfactants based on block copolymers which contain at least one polyethylene-oxide block and at least one polypropylene-oxide block, the polyethylene-oxide block of which comprises on average a number of 2 to 100 ethylene-oxide units and the polypropylene-oxide block of which comprises on average a number of 2 to 100 propylene-oxide units, wherein, if applicable, independently of one another in each case one or more polyethylene-oxide blocks or polypropylene-oxide blocks can be contained in the molecule.

The contents of demulsifying surfactants and/or further, in particular non-ionic, surfactants are removed proportionately with the contaminants from the cleaning baths and therefore need to be supplemented again in a corresponding manner in order to preserve the cleaning power or re-adjust it. The surfactants, which are not cationic surfactants, are not usually subject to any chemical reactions, usually remain in solution, and thus usually remain preserved proportionately or extensively in the bath, yet are removed from the bath proportionately with the contaminants.

In the case of discontinuous operation, it can be worthwhile exchanging the whole contents of the bath (bath-change) when cleaning the system during the removal of the contaminant.

In the case of the method in accordance with the invention at least one cationic organic compound, which is contained in the cleaner-bath and/or is added to it, is preferably selected from the group consisting of cationic surfactants and cationic organic polymers. In this connection, the term "cationic polymers", as at the other points as well at which the further polymeric variants are not listed, stands for a selection from the group consisting of cationic polymers, cationic copolymers, cationic block copolymers and cationic graft polymers. The cationic organic compounds are used in particular to produce and/or to boost the, if applicable, weakly demulsifying, too weakly demulsifying or even not demulsifying operation and action of the bath containing at least one demulsifying, in particular non-ionic, surfactant, and/or to maintain the demulsifying operation and action of the bath for as long as possible or even permanently, on the basis of the demulsifying action on the one hand of the at least one non-ionic surfactant in accordance with the invention and on the other hand, if applicable, as well of the at least one cationic surfactant. As a result of the demulsifying operation, oil is separated from the bath, and the useful life of the bath is extended.

At least one cationic organic compound is preferably selected a) from amphophilic compounds which have at least one quaternary ammonium group and/or at least one ring group with at least one nitrogen atom as head group, wherein either the at least one nitrogen atom of the ring group or the ring group has at least one positive charge, and they have at least one alkyl group independently of one another—saturated or unsaturated—with in each case an average number of carbon atoms in the range from 4 to 22 carbon atoms with in each case either a linear or branched chain formation, wherein the alkyl group can contain, if applicable, independently of one another—saturated or unsaturated, branched or unbranched—in each case one or more aromatic groups or can be replaced by them, and wherein, if applicable, at least one alkyl group can have a different average number of carbon atoms from at least one other alkyl group, and/or b) from cationic polymers which in the case of water-soluble cationic polymers are often also cationic polyelectrolytes, wherein the cationic polymers contain at least one quaternary ammonium group and/or at least one nitrogen-containing, heterocyclic positively charged group with 5 or 6 ring atoms and at least five units of a monomer fundamental building block or a plurality of—in particular one, two, three, four or five—different monomer fundamental building blocks in at least one polymer chain. As monomer fundamental building blocks there come into consideration in this connection cationically charged polymers, in particular cationic polyelectrolytes, in particular those which contain at least one quaternary nitrogen atom, at least one guanidinium group, at least one quaternized imidazoline group (=imidazolium group), at least one quaternized oxazolium group and/or at least one quaternized pyridyl group (=pyridinium group), such as, for example, those, based on ethylene imine(s), hexamethylenediamine guanidium compounds, oxazolium, vinyl imidazolium, vinyl pyridinium compounds, such as, for example, the corresponding chlorides. In particular, 1 to 1,000,000 quaternary ammonium groups and/or 1 to 1,000,000 nitrogen-containing heterocyclic positively charged groups with 5 or 6 ring atoms can occur in one molecule, and in each case independently of one another preferably 5 to 800,000, particularly preferably 15 to 600,000, especially preferably 25 to 400,000. In particular, 5 to 1,500,000 units of a monomer fundamental building block or a plurality of different monomer fundamental building blocks can occur in one molecule, and in each case independently of one another preferably 25 to 1,100,000, particularly preferably 75 to 600,000, especially preferably 100 to 200,000. In the case of different types of monomer fundamental building blocks in one molecule, these can—if applicable in certain ranges—be arranged statistically, isotactically, syndiotactically, atactically and/or block-wise, for example as block copolymers or graft copolymers.

In this connection, at least one cationic organic compound is preferably selected from amphiphilic compounds of the general formula (I)

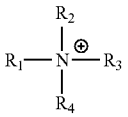

wherein $N^{\oplus}$ represents nitrogen as a quaternary ammonium compound, wherein $R_1$ is an alkyl group—saturated or unsaturated—with an average number of carbon atoms in the range from 8 to 18 carbon atoms with in each case either a linear or branched chain formation, wherein the alkyl group $R_1$ can contain, if applicable, one or more aromatic and/or phenolic groups or can be replaced by them, wherein $R_2$ is hydrogen, $(EO)_x$ (=polyether chain of the formula "—$CH_2$—$CH_2$—O—" with x=1 to 50 units with or without end-group closure, in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure in particular with a methyl, ethyl, propyl, isopropyl, n-butyl, isobutyl, tertiary butyl or benzyl group) or an alkyl group—saturated or unsaturated—with an average number of carbon atoms in the range from 1 to 18 carbon atoms with either a linear or branched chain formation, wherein the alkyl group $R_2$ can contain, if applicable, one or more aromatic and/or phenolic groups or can be replaced by them, wherein $R_3$ and $R_4$ are, independently of one another, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 10 with in each case either a linear or branched chain formation, wherein, if applicable, $R_3$ and/or $R_4$ can contain independently of one another one or more aromatic and/or phenolic groups or can be replaced by them, wherein, if applicable, $R_2$, $R_3$ and/or $R_4$ can contain and/or represent independently of one another one or more groups selected from amino groups, carbonyl groups, ester groups, ether groups, OH groups and nitro groups on at least, one of the carbon atoms and/or between the carbon atoms at least of one alkyl group.

In a particularly preferred manner at least one cationic surfactant has one or two benzyl groups.

It is particularly preferred in the case of compounds of the general formula (I) to select in the case of $R_2$ alkyl groups with 1 or with 8 to 16 carbon atoms; it is especially preferred to select these from 1 or 10 to 14 carbon atoms. It is particularly preferred in the case of compounds of the general formula (I) to select in the case of $R_3$ alkyl groups with 1 or 6 carbon atoms, the latter in particular as a benzyl group.

In this connection, at least one cationic organic compound is preferably selected from amphophilic compounds of the general formula (II)

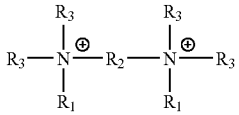

wherein $N^{\oplus}$ represents nitrogen as a quaternary ammonium compound, wherein $R_1$ is, independently of one another, an alkyl group—saturated or unsaturated—with an average number of carbon atoms in the range from 4 to 22 carbon atoms with in each case either a linear or branched chain formation, wherein, if applicable, at least one of the alkyl groups $R_1$ can contain independently of one another one or more aromatic and/or phenolic groups and/or can be replaced by them, wherein $R_2$ is an alkyl group—saturated or unsaturated—with an average number of carbon atoms in the range from 1 to 22 carbon atoms with either a linear or branched chain formation, wherein the alkyl group $R_2$ can contain, if applicable, one or more aromatic and/or phenolic groups or can be replaced by them, wherein $R_3$ is independently of one another hydrogen, $(EO)_x$ (=polyether chain of the formula "—$CH_2$—$CH_2$—O—" with x=1 to 50 units in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 10 with in each case either a linear or branched chain formation, wherein, if applicable, at least one of the alkyl groups $R_3$ can contain independently of one another one or more aromatic and/or phenolic groups and/or can be replaced by them, wherein, if applicable, $R_2$ can contain independently of one another one or more groups selected from amino groups, carbonyl groups, ester groups, ether groups, OH groups and nitro groups on at least one of the carbon atoms and/or between the carbon atoms at least of one alkyl group, wherein, if applicable, at least one group $R_3$ can contain and/or can represent independently of one another one or more groups selected from amino groups, carbonyl groups, ester groups, ether groups, OH groups and nitro groups on at least one of the carbon atoms and/or between the carbon atoms at least of one alkyl group.

It is particularly preferred in the case of compounds of the general formula (II) to select in the case of $R_2$ alkyl groups with 1 or 8 to 16 carbon atoms; it is especially preferred to select these from 1 or 10 to 14 carbon atoms. It is particularly preferred in the case of compounds of the general formula (II) to select in the case of $R_3$ alkyl groups with 1 or 6 carbon atoms, the latter in particular as a benzyl group.

In this connection, at least one cationic organic compound is preferably selected from amphiphilic compounds of the general formula (III)

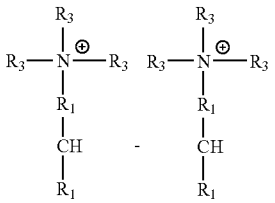

wherein $N^{\oplus}$ represents nitrogen as a quaternary ammonium compound, wherein, if applicable, CH—CH can be replaced by CH—$R_4$—CH, wherein $R_4$ is, independently of one another, an alkyl group—saturated or unsaturated—with an average number of carbon atoms in the range from 1 to 14 carbon atoms with in each case either a linear or branched chain formation, wherein, if applicable, at least one of the alkyl groups $R_4$ can contain independently of one another one or more aromatic and/or phenolic groups and/or can be replaced by them, wherein, if applicable, at least one of the alkyl groups $R_4$ can contain independently of one another also at least one amino group, carbonyl group, ester group, ether group, OH group and nitro group on at least one of the carbon atoms and/or between the carbon atoms of at least one alkyl group, wherein, if applicable, $N^{\oplus}$—CH can be replaced by $N^{\oplus}$—$R_5$—CH, wherein $R_5$ is, independently of one another, an alkyl group—saturated or unsaturated—with an average number of carbon atoms in the range from 1 to 8 carbon atoms with in each case either a linear or branched chain formation, wherein, if applicable, at least one of the alkyl groups $R_5$ can contain independently of one another one or more aromatic and/or phenolic groups and/or can be replaced by them, wherein, if applicable, at least one of the alkyl groups $R_5$ can contain independently of one another also at least one amino group, carbonyl group, ester group, ether group, OH group and nitro group on at least one of the carbon atoms and/or between the carbon atoms at least of one alkyl group, wherein $R_1$ is, independently of one another, hydrogen or an alkyl group—saturated or unsaturated—with an average number of carbon atoms in the range from 4 to 22 carbon atoms with in each case either a linear or branched chain formation, wherein, if applicable, at least one of the alkyl groups $R_1$ can contain independently of one another one or more aromatic and/or phenolic groups and/or can be replaced by them, wherein $R_3$ is independently of one another hydrogen, $(EO)_x$ (=polyether chain of the formula "—$CH_2$—$CH_2$—O—" with x=1 to 50 units with or without end-group closure for each, polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 10 with in each case either a linear or branched chain formation, wherein, if applicable, at least one of the alkyl groups $R_3$ can contain independently of one another one or more aromatic and/or phenolic groups and/or can be replaced by them, wherein, if applicable, at least one of the groups $R_3$ can contain and/or represent independently of one another one or more groups selected from amino groups, carbonyl groups, ester groups, ether groups, OH groups and nitro groups on at least one of the carbon atoms and/or between the carbon atoms at least of one alkyl group.

It is particularly preferred in the case of the compounds of the general formula (III) to select in the case of $R_4$ alkyl groups with 1 to 4 carbon atoms; it is especially preferred to select these from 2 or 3 carbon atoms. It is particularly preferred in the case of the compounds of the general formula (III) to select in the case of $R_5$ alkyl groups with 1 to 6 carbon atoms; it is especially preferred to select these from 2 to 5 carbon atoms.

In this connection, at least one cationic organic compound is preferably selected from amphiphilic compounds of the general formula (IV) and the tautomers thereof

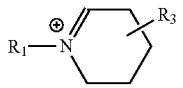

wherein $N^{\oplus}$ represents nitrogen, wherein, one, two, three, four, five, six, seven, eight or nine $R_3$ can be bound to the ring of the general formula (IV), wherein the $R_1$ bound to the nitrogen is obligatory and the $R_3$ bound to the ring is optional, wherein the ring has one, two or three double bonds, wherein, if applicable, in the ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein, if applicable, a further one, two, three or four cyclic groups which are saturated, unsaturated or aromatic can be condensed onto the first ring independently of one another with 5 or 6 ring atoms, wherein, if applicable, one, two, three or four $R_3$ can be bound independently of one another in this at least one further ring, wherein, if applicable, in this at least one further ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein $R_1$ is an alkyl group—saturated or unsaturated—with an average number of carbon atoms in the range from 4 to 22 carbon atoms with in each case either a linear or branched chain formation, wherein, if applicable, the alkyl group $R_1$ can contain one or more aromatic and/or phenolic groups or can be replaced by them, wherein $R_3$ is, independently of one another, hydrogen, an amino group, a carbonyl group, an ester group, an ether group, a nitro group, an OH group, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 6 carbon atoms with in each case either a linear or branched chain formation, wherein, if applicable, at least one of the alkyl groups $R_3$ can contain independently of one another one or more aromatic and/or phenolic groups or can be replaced by them, wherein, if applicable, at least one group $R_3$ can contain independently of one another one or more groups selected from amino groups, carbonyl groups, ester groups, ether groups, OH groups and nitro groups on at least one of the carbon atoms and/or between the carbon atoms at least of one alkyl group.

In this connection, at least one cationic organic compound is preferably selected from amphiphilic compounds of the general formula (V) and the tautomers thereof

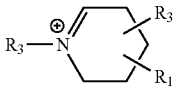

wherein $N^{\oplus}$ represents nitrogen, wherein, if applicable, one, two, three, four, five, six, seven or eight $R_3$ can be bound to the ring of the general formula (V), wherein the $R_3$ bound to the nitrogen and the $R_1$ bound to the ring are obligatory and wherein the $R_3$ bound to the ring is optional, wherein the ring has one, two or three double bonds, wherein, if applicable, in the ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein, if applicable, a further one, two, three or four cyclic groups which are saturated, unsaturated or aromatic can be condensed onto the first ring independently of one another with 5 or 6 ring atoms, wherein, if applicable, one, two, three or four $R_3$ can be bound independently of one another in this at least one further ring, wherein, if applicable, in this at least one further ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein $R_1$ is an alkyl group—saturated or unsaturated—with an average number of carbon atoms in the range from 4 to 22 carbon atoms with in each case either a linear or branched chain formation, wherein, if applicable, the alkyl group $R_1$ can contain one or more aromatic and/or phenolic groups or can be replaced by them, wherein $R_1$ is bound on a carbon atom without any double bond or on a carbon atom with one double bond, wherein $R_3$ is, independently of one another, hydrogen, an amino group, a carbonyl group, an ester group, an ether group, a nitro group, an OH group, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 6 carbon atoms with in each case either a linear or branched chain formation, wherein, if applicable, at least one of the alkyl groups $R_3$ can contain independently of one another one or more aromatic and/or phenolic groups or can be replaced by them, wherein, if applicable, at least one group $R_3$ can contain independently of one another one or more groups selected from amino groups, carbonyl groups, ester groups, ether groups, OH groups and nitro groups on at least one of the carbon atoms and/or between the carbon atoms at least of one alkyl group.

In this connection, at least one cationic organic compound is preferably selected from amphiphilic compounds of the general formula (VI) and the tautomers thereof

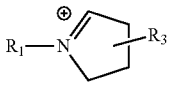

wherein $N^{\oplus}$ represents nitrogen, wherein, if applicable, one, two, three, four, five, six or seven $R_3$ can be bound to the ring, wherein the ring has one or two double bonds, wherein the $R_1$ bound to the nitrogen is obligatory and the $R_3$ bound to the ring is optional, wherein, if applicable, in the ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein, if applicable, a further one, two or three cyclic groups which are saturated, unsaturated or aromatic can be condensed onto the first ring independently of one another with 5 or 6 ring atoms, wherein, if applicable, one, two, three or four $R_3$ can be bound independently of one another in this at least one further ring, wherein, if applicable, in this at least one further ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein $R_1$ is an alkyl group—saturated or unsaturated—with an average number of carbon atoms in the range from 4 to 22 carbon atoms with in each case either a linear or branched chain formation, wherein the alkyl group $R_1$, if applicable, can contain one or more aromatic and/or phenolic groups or can be replaced by them, wherein $R_3$ is, independently of one another, hydrogen, an amino group, a carbonyl group, an ester group, an ether group, a nitro group, an OH group, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with for each polyether chain independently of one another or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 6 carbon atoms with in each case either a linear or branched chain formation, wherein, if applicable, at least one of the alkyl groups $R_3$ can contain independently of one another one or more aromatic and/or phenolic groups or can be replaced by them, wherein, if applicable, at least one group $R_3$ can contain independently of one another one or more groups selected from amino groups, carbonyl groups, ester groups, ether groups, OH groups and nitro groups on at least one of the carbon atoms and/or between the carbon atoms at least of one alkyl group.

In this connection, at least one cationic organic compound is preferably selected from amphiphilic compounds of the general formula (VII) and the tautomers thereof

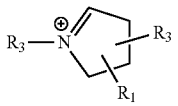

wherein $N^{\oplus}$ represents nitrogen, wherein one, two, three, four, five or six $R_3$ can be bound to the ring, wherein the ring has one or two double bonds, wherein the $R_3$ bound to the nitrogen and the $R_1$ bound to the ring are obligatory and wherein the $R_3$ bound to the ring is optional, wherein, if applicable, in the ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein, if applicable, a further one, two or three saturated, unsaturated and/or aromatic cyclic groups can be condensed onto the first ring independently of one another with 5 or 6 ring atoms, wherein, if applicable, one, two, three or four $R_3$ can be bound independently of one another in this at least one further ring, wherein, if applicable, in this at least one further ring independently of one another one or more carbon atoms can be replaced by at least one nitrogen atom, at least one sulphur atom and/or by at least one oxygen, wherein, if applicable, one $R_3$ can be bound to this at least one nitrogen atom, wherein $R_1$ is an alkyl group—saturated or unsaturated—with an average number of carbon atoms in the range from 4 to 22 carbon atoms with in each case either a linear or branched chain formation, wherein the alkyl group $R_1$, if applicable, can contain one or more aromatic and/or phenolic groups or can be replaced by them, wherein $R_3$ is, independently of one another, hydrogen, an amino group, a carbonyl group, an ester group, an ether group, a nitro group, an OH group, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group), $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) and/or an alkyl group—saturated or unsaturated—with an average number of carbon atoms in the range from 1 to 6 carbon atoms with in each case either a linear or branched chain formation, wherein at least one of the alkyl groups $R_3$ can contain independently of one another, if applicable, one or more aromatic and/or phenolic groups or can be replaced by them, wherein, if applicable, at least one group $R_3$ can contain independently of one another one or more groups selected from amino groups, carbonyl groups, ester groups, ether groups, OH groups and nitro groups on at least one of the carbon atoms and/or between the carbon atoms at least of one alkyl group.

Preferably at least one amphiphilic cationic organic compound of the general formulae (I), (II) and (III) has at the head group or groups with a central nitrogen atom in each case at least one hydroxyl, ethyl, methyl, isopropyl, propyl and/or benzyl group independently of one another as $R_2$ and/or $R_3$, wherein, if applicable, at least one longer alkyl chain and/or a plurality of alkyl chains can also occur. In the case of the cationic organic compounds of the general formulae (I), (II), (III), (IV), (V), (VI) and (VII) and also in the case of the tautomers thereof $R_1$ has—independently of one another, saturated or unsaturated, branched or unbranched—if applicable, one or more aromatic and/or phenolic groups. In the case of the cationic organic compounds of the general formulae (I), (II), (III), (IV), (V), (VI) and (VII) and also in the case of the tautomers thereof $R_3$ has—independently of one another, saturated or unsaturated, branched or unbranched—if applicable, one or more aromatic and/or phenolic groups, wherein at least one of the alkyl groups can be, if applicable, independently of one another in each case at least one methyl group, ethyl group, hydroxyl group, isopropyl group, propyl group and/or a benzyl group. Preferably in those cases with compounds of the general formulae (I), (II), (III), (IV), (V), (VI) and (VII), and also with the tautomers thereof in which $(PO)_y$ is contained, $(EO)_x$ also occurs, with it, however, if applicable, also being preferred that $(EO)_x$ be contained alone without $(PO)_y$.

It is particularly preferred in the case of the compounds of the general formulae (I), (II), (III), (IV), (V), (VI) and (VII) and also in the case of the tautomers thereof to select in the case of $R_1$ alkyl groups with 8 to 16 carbon atoms; it is especially preferred to select these of 10 to 14 carbon atoms. It is particularly preferred in the case of the compounds of the general formulae (I), (II), (III), (IV), (V), (VI) and (VII) and also in the case of the tautomers thereof to select x from 1 to 7 units; it is especially preferred to select x from 4 or 5 units. It is particularly preferred in the case of the compounds of the general formulae (I), (II), (III), (IV), (V), (VI) and (VII) and also in the case of the tautomers thereof to select y from 1 to 4 units; it is especially preferred to select y from 2 or 3 units. It is particularly preferred in the case of the compounds of the general formulae (I), (II), (III), (IV), (V), (VI) and (VII) and also in the case of the tautomers thereof to select in the case of $R_3$ alkyl groups with 1 or 6 carbon atoms, the latter in particular as a benzyl group.

In this connection, at least one cationic organic compound is preferably selected from cationic polymers, cationic copolymers, cationic block copolymers and cationic graft copolymers which contain at least one cationic group of the general formula (VIII):

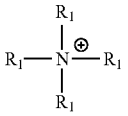

wherein the compound has 1 to 500,000 cationic groups which independently of one another have the chemical structures mentioned in the following, wherein $N^{\oplus}$ represents nitrogen as a quaternary ammonium group, wherein at least one quaternary ammonium group has at least one alkyl group $R_1$ which has, independently of one another, hydrogen, an alkyl group A—saturated or unsaturated, branched or unbranched—with a number of 1 to 200 carbon atoms and/or represents an oxygen-containing group, such as, for example, an OH group or oxygen as a bridge atom to the next group, such as, for example, an alkyl group B with a number of 1 to 200 carbon atoms, wherein the predominant number of quaternary ammonium groups has at least two alkyl groups $R_1$ which has, independently of one another, hydrogen, an alkyl group A—saturated or unsaturated, branched or unbranched—with a number of 1 to 200 carbon atoms and/or represent an oxygen-containing group, such as, for example, an OH group or oxygen as a bridge atom to the next group, such as, for example, an alkyl group B with a number of 1 to 200 carbon atoms, wherein, if applicable, at least one alkyl group A and/or at least one alkyl group B can contain independently of one another one or more aromatic and/or phenolic groups or can be replaced by them, wherein, if applicable, at least one alkyl group A and/or at least one alkyl group B can be independently of one another one or more groups selected from hydrogen, an amino group, a carbonyl group, an ester group, an ether group, a nitro group, an OH group, $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group) and $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) on at least one of the carbon atoms and/or between the carbon atoms of the alkyl group A and/or of the alkyl group B and/or can be replaced by these, wherein, if applicable, there can be bound to at least one alkyl group $R_1$ independently of one another at least one polymer chain independently of one another branched or unbranched with a number of the polymer units n consisting of 5 to 1,000,000 monomer fundamental building blocks, wherein the polymer units of at least one cationic group are selected at least in part from polyamides, polycarbonates, polyesters, polyethers, polyamines, polyimines, polyolefines, polysaccharides, polyurethanes, derivatives thereof, mixtures thereof and combinations thereof, wherein, if applicable, at least one uncharged monomer and/or at least one corresponding uncharged group can occur independently of one another as the monomer fundamental building block(s), wherein, if applicable, at least one quaternary ammonium group can appear independently of one another with the nitrogen atom in the polymer chain and/or with the nitrogen atom on the polymer chain.

In the case of the compounds selected from compounds of the general formulae VIII, IX and X and the tautomers thereof a combination of cationic groups consisting of at least two distinct cationic groups of different general formulae VIII, IX and X and/or the tautomers thereof can also occur in at least one compound.

In the case of the compounds of the general formulae VIII, IX and X and the tautomers thereof the cationic group, presented in these general formulae, and/or the tautomeric cationic group thereof can be present in each case independently of one another at least once, in quite a few embodiments, however, with at least 2, preferably with 3, 4, 5, 6, 7, 8 to 20, 21 to 30, 31 to 40, 41 to 50, 51 to 60, 61 to 100, 101 to 200, 201 to 500, 501 to 1,000, 1,001 to 2,000, 2,001 to 5,000, 5,001 to 10,000, 10,001 to 50,000, 50,001 to 100,000, 100,001 to 200,000, 200,001 to 500,000 cationic groups. In quite a few variant embodiments there is a mixture of compounds selected from compounds of the general formulae VIII, IX and X and the tautomers thereof, the number of cationic groups of which lies in the range from 30 to 300,000, preferably in the range from 100 to 100,000, sometimes in the range from 100 to 50,000, in the range from 800 to 120,000 or in the range from 2,000 to 250,000. Frequently, a mixture of these compounds occurs with a smaller or larger band width of the number of cationic groups and/or with a smaller or larger band width of the number of polymer units n. It is particularly preferred in this connection that such a compound have a number of polymer units n that is greater by a factor of 1 to 1000 than the number of cationic groups including the tautomeric cationic groups thereof, if applicable contained therein, in particular by a factor in the range from 1.5 to 100, especially preferably by a factor in the range from 2 to 30, above all by a factor in the range from 3 to 12 or from 3.5 to 8.

In the case of the compounds selected from compounds of the general, formulae VIII, IX and X and the tautomers thereof preferably at least one quaternary ammonium group appears, independently of one another, with the nitrogen atom in the polymer chain and/or with the nitrogen atom on the polymer chain, sometimes in the case of at least 25% of all such groups present or in the case of at least 75% of all such groups present. They appear in an especially preferred manner predominantly, almost completely or completely independently of one another with the nitrogen atom in the polymer chain and/or with the nitrogen atom on the polymer chain.

In the case of the compounds selected from compounds of the general formulae VIII, IX and X and the tautomers thereof the polymer units of at least one cationic group are particularly preferably predominantly, almost completely or completely selected from polyamides, polycarbonates, polyesters, polyethers, polyamines, polyimines, polyolefines, polysaccharides, polyurethanes, derivatives thereof, mixtures thereof and combinations thereof. In quite a few variant embodiments such compounds are selected in particular in such a way that the polymer units of at least 25% of all the cationic groups, of more than 50% of all the cationic groups, of at least 75% of all the cationic groups, of almost all the cationic groups or of all the cationic groups in each case independently of one another are at least 25%, predominantly (≥50%), at least 75%, almost completely or completely selected from polyamides, polycarbonates, polyesters, polyethers, polyamines, polyimines, polyolefines, polysaccharides, polyurethanes, derivatives thereof, mixtures thereof and combinations thereof.

In the case of the compounds selected from compounds of the general formulae VIII, IX and X and the tautomers thereof as the monomer fundamental building block(s) there occur in a particularly preferred manner predominantly, almost completely or completely independently of one another uncharged monomers and/or corresponding uncharged groups.

In the case of the compounds of the general formulae VIII, IX and X and the tautomers thereof there can occur as derivatives of the polymer units of the polyolefines, for example, at least one compound of polyethylenes, polypropylenes, polystyrenes, polyvinyl alcohols, polyvinyl amines, polyvinyl esters, such as, for example, polyvinyl acetates, polyvinyl ethers, polyvinyl ketones and derivatives thereof, mixtures thereof and combinations thereof.

In the case of the compounds of the general formulae VIII, IX and X and the tautomers thereof there can occur as derivatives of the polymer units of the polyamides, for example, at least one compound of polyamino acids, polyaramides and derivatives thereof, mixtures thereof and combinations thereof, selected in particular from diaminocarboxylic acids, diaminodicarboxylic acids and derivatives thereof, mixtures thereof and combinations thereof.

In the case of the compounds of the general formulae VIII, IX and X and the tautomers thereof there can occur as derivatives of the polymer units of the polyesters, for example, at least one compound of hydroxycarboxylic acids, dihydroxycarboxylic acids, polycarbonates and derivatives thereof, mixtures thereof and combinations thereof, selected in particular from polyester polycarbonates and derivatives thereof, mixtures thereof and combinations thereof.

In the case of the compounds of the general formulae VIII, IX and X and the tautomers thereof there can occur as derivatives of the polymer units of the polyethers, for example, at least one compound of polyether block amides, polyalkylene glycols, polyamides, polyether ether ketones, polyether imides, polyether sulphones and derivatives thereof, mixtures thereof and combinations thereof.

In the case of the compounds of the general formulae VIII, IX and X and the tautomers thereof there can occur as derivatives of the polymer units of the polyamines, for example, at least one compound of alkylene diamines, polyethylene imines, vinylamine polymers and derivatives thereof, mixtures thereof and combinations thereof, selected in particular from diethylenediamines, dipropylenediamines, ethylenediamines, propylenediamines, triethylenediamines, tripropylenediamines, polyethylenediamines, polypropylenediamines, vinylamine polymers and derivatives thereof, mixtures thereof and combinations thereof.

In the case of the compounds of the general formulae VIII, IX and X and the tautomers thereof there can occur as derivatives of the polymer units of the polysaccharides, for example, at least one compound of corresponding biopolymers, such as those based on cellulose, glycogen, starch and derivatives thereof, modifications thereof, mixtures thereof and combinations thereof, selected in particular from polyglucosides, condensation products of fructose or glucose and derivatives thereof, mixtures thereof and combinations thereof.

In this connection, at least one cationic organic compound is preferably selected from cationic polymers, cationic copolymers, cationic block copolymers and cationic graft copolymers which contain at least one cationic group of the general formula (IX) and/or the tautomers thereof:

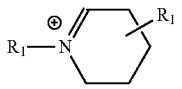

wherein the compound has 1 to 500,000 cationic groups which independently of one another have the chemical structures mentioned in the following, wherein $N^{\oplus}$ represents nitrogen, wherein zero, one, two, three, four, five, six, seven, eight or nine $R_1$ are bound to the ring of the cationic group independently of one another, wherein the $R_1$ bound to the nitrogen is obligatory and the $R_1$ bound to the ring is optional, wherein the ring of the cationic group has, independently of one another, one, two or three double bonds, wherein, if applicable, in the ring of the cationic group independently of one another one or more carbon atoms can be replaced by at least one nitrogen atom, at least one sulphur atom and/or by at least one oxygen, wherein, if applicable, a further one, two, three or four saturated, unsaturated and/or aromatic cyclic groups with 5 or 6 ring atoms can be condensed onto the first ring of the cationic group independently of one another, wherein, if applicable, one, two, three or four $R_1$ can be bound independently of one another in this at least one further ring, wherein, if applicable, in this at least one further ring independently of one another one or more carbon atoms can be replaced by at least one nitrogen atom, at least one sulphur atom and/or at least one oxygen, wherein, if applicable, $R_1$ can represent, independently of one another, an alkyl group A—saturated or unsaturated, branched or unbranched—with a number of 1 to 200 carbon atoms which can contain, if applicable, one or more aromatic and/or phenolic groups independently of one another or can be replaced by them, and/or a group selected from amino groups, carbonyl groups, ester groups, ether groups, OH groups, nitro groups, groups $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group) and/or groups $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) independently of one another and/or can represent an oxygen-containing group which has oxygen as a bridge atom to the next alkyl group B—saturated or unsaturated, branched or unbranched—with a number of 1 to 200 carbon atoms, which can, if applicable, contain one or more aromatic and/or phenolic groups independently of one another or can be replaced by them, and/or can, if applicable, contain a group selected from amino groups, carbonyl groups, ester groups, ether groups, OH groups and nitro groups on at least one of the carbon atoms and/or between the carbon atoms in each case at least of one of the alkyl groups A and/or B, and/or wherein, if applicable, there can be bound to at least one of the groups $R_1$ independently of one another at least one polymer chain independently of one another branched or unbranched with a number of the polymer units n consisting of 5 to 1,000,000 monomer fundamental building blocks, wherein the polymer units of at least one cationic group are selected at least in part from polyamides, polycarbonates, polyesters, polyethers, polyamines, polyimines, polyolefines, polysaccharides, polyurethanes, derivatives thereof, mixtures thereof and combinations thereof, wherein, if applicable, at least one uncharged monomer and/or at least one corresponding uncharged group can occur independently of one another as the monomer fundamental building block(s), wherein, if applicable, at least one quaternary ammonium group can appear, independently of one another, with the nitrogen atom in the polymer chain and/or with the nitrogen atom on the polymer chain.

In this connection, at least one cationic organic compound is preferably selected from cationic polymers, cationic copolymers, cationic block copolymers and cationic graft copolymers which contain at least one cationic group of the general formula (X) and/or the tautomers thereof:

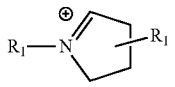

wherein the compound has 1 to 500,000 cationic groups which independently of one another have the chemical structures mentioned in the following, wherein $N^{\oplus}$ represents nitrogen, wherein zero, one, two, three, four, five, six or seven $R_1$ are bound to the ring of the cationic group independently of one another, wherein the $R_1$ bound to the nitrogen is obligatory and the $R_1$ bound to the ring is optional, wherein the ring of the cationic group has, independently of one another, one or two double bonds, wherein, if applicable, in the ring of the cationic group independently of one another one or more carbon atoms can be replaced by at least one nitrogen atom, at least one sulphur atom and/or by at least one oxygen, wherein, if applicable, a further one, two or three saturated, unsaturated and/or aromatic cyclic groups with 5 or 6 ring atoms can be condensed onto the first ring of the cationic group independently of one another, wherein, if applicable, one, two, three or four $R_1$ can be bound independently of one another in this at least one further ring, wherein, if applicable, in this at least one further ring independently of one another one or more carbon atoms can be replaced by at least one nitrogen atom, at least one sulphur atom and/or at least one oxygen, wherein, if applicable, $R_1$ is, independently of one another, an alkyl group A—saturated or unsaturated, branched or unbranched—with a number of 1 to 200 carbon atoms which can contain, if applicable, one or more aromatic and/or phenolic groups independently of one another or can be replaced by them, and/or can represent a group selected from amino groups, carbonyl groups, ester groups, ether groups, OH groups, nitro groups, groups $(EO)_x$ (=polyether chain of the formula "—$CH_2$—$CH_2$—O—" with x=1 to 50 units with or without end-group closure for each polyether chain independently of one another in particular with a methyl, ethyl, propyl, isopropyl, n-butyl, isobutyl, tertiary butyl or benzyl group) and/or groups $(PO)_y$ (=polyether chain of the formula "—$CHCH_3$—$CH_2$—O—" with y=1 to 10 units with or without end-group closure for each polyether chain independently of one another in particular with a methyl, ethyl, propyl, isopropyl, n-butyl, isobutyl, tertiary butyl or benzyl group) independently of one another and/or can contain an oxygen-containing group which can represent oxygen as a bridge atom to the next alkyl group B—saturated or unsaturated, branched or unbranched—with a number of 1 to 200 carbon atoms, which can, if applicable, contain one or more aromatic and/or phenolic groups independently of one another or can be replaced by them, and/or if applicable, a group selected from amino groups, carbonyl groups, ester groups, ether groups, OH groups and nitro groups on at least one of the carbon atoms and/or between the carbon atoms in each case at least of one of the alkyl groups A and/or B, and/or wherein, if applicable, there can be bound to at least one alkyl group $R_1$ independently of one another at least one polymer chain independently of one another branched or unbranched with a number of the polymer units n consisting of 5 to 1,000,000 monomer fundamental building blocks, wherein the polymer units of at least one cationic group are selected at least in part from polyamides, polycarbonates, polyesters, polyethers, polyamines, polyimines, polyolefines, polysaccharides, polyurethanes, derivatives thereof, mixtures thereof and combinations thereof, wherein, if applicable, at least one uncharged monomer and/or at least one corresponding uncharged group can occur independently of one another as the monomer fundamental building block(s), wherein, if applicable, at least one quaternary ammonium group can appear, independently of one another, with the nitrogen atom in the polymer chain and/or with the nitrogen atom on the polymer chain.

In the case of the cationic polymers—this term, as at other points as well at which the further polymeric variants are not listed, stands for a selection from the group consisting of cationic polymers, cationic copolymers, cationic block copolymers and cationic graft polymers—the at least one alkyl group—saturated or unsaturated, branched or unbranched—can preferably have in each case independently of one another 3 to 160 carbon atoms, particularly preferably 5 to 120 carbon atoms, especially preferably 8 to 90 carbon atoms. It is particularly preferred to select x from 1 to 7 units; it is especially preferred to select x from 4 or 5 units. It is particularly preferred to select y from 1 to 4 units; it is especially preferred to select y from 2 or 3 units.

In the case of the method in accordance with the invention the counterions to the amphiphilic compounds and to the cationic polymers are preferably anions selected from the group consisting of ions based on alkyl sulphate, carbonate, carboxylate, halide, nitrate, phosphate, phosphonate, sulphate and/or sulphonate. In particular as well ions based on halide, such as, for example, bromide and/or chloride, and/or ions based on carboxylate, in particular such as, for example, acetate, benzoate, formate, gluconate, heptonate, lactate, propionate, fumarate, maleinate, malonate, oxalate, phthalate, succinate, tartrate, terephthalate and/or citrate, can occur as counterions. In the case of the cationic polymers preferably only or substantially only monovalent ions occur as counterions.

Both the cationic organic compounds and the anionic organic compounds are as a rule polar and soluble in water. If the cationic organic compounds come into contact with the anionic organic compounds derived in particular from the contaminant, the ions are neutralized. In this connection, the cations, such as in particular the alkalis and/or alkaline earths, above all ammonium, sodium and/or potassium ions, and also the anions, such as in particular chloride ions, go into the aqueous solution and can remain there. On account of the removal, losses, such as, for example, as a result of discharge, and/or circulation of the bath solution, the quantity of water is to be supplemented time and again so that in many cases the salts do not build up too greatly.

On the other hand, the cationic organic compounds and the anionic organic compounds often with salt-formation with ionic interaction form reaction products which are mostly adducts that are very hydrophobic and insoluble in water. These reaction products therefore accumulate in the oil-containing contaminants and/or in the oil-containing phase to a greater extent and can be removed with them. These reaction products constitute a disturbance, because they are very hydrophobic and behave in a disturbing manner like oils.

In the case of the method in accordance with the invention in many variant embodiments it is advantageous if a content of cationic organic compounds is added to the bath, in particular during discontinuous operation, in a quantity at which the stoichiometric ratio of cationic organic compounds to anionic organic compounds is kept in the range from 0.1:1 to 10:1. In particular, this ratio is in the range from 0.5:1 to 5:1, particularly preferably in the range from 0.7:1 to 1.2:1, especially preferably in the range from 0.9:1 to 1:1.

In this connection, in particular in the case of discontinuous operation, in many variant embodiments it is preferred to add no more than 1 g/l cationic organic compounds, particularly preferably no more than 0.1 g/l, especially preferably no more than 0.01 g/l cationic organic compounds.

If the at least one cationic organic compound is contained in the bath at a deficient level in comparison with the unreacted anionic organic compounds that are present, then the bath is mostly only weakly or very weakly demulsifying. If the at least one cationic organic compound is contained in the bath to excess in comparison with the unreached anionic organic compounds that are present, then the bath is emulsifying and scarcely contains oil(s) and/or contaminants connected therewith, but the cleaning power will usually have already decreased. In a mid-range of this ratio of cationic organic compounds to the unreached anionic organic compounds that are present in the bath, usually not only the demulsifying effect of the bath, but also its cleaning power is high and at the same time the content of oil(s) and/or contaminants connected therewith is low or very low. It is therefore recommended in the case of many variant embodiments that there be operation say in the threshold region of cationic behaviour to anionic behaviour. A higher cleaning power is also linked with a better cleaning result.

In many variant embodiments it is advantageous if the cleaner-bath additionally contains at least one cleaner-framework, that is, at least one builder, and/or this is added to the bath. The cleaner-framework can help to suppress rusting, such as, for example, flash rusting on steel or white-rust formation on zinc surfaces. The cleaner-framework can preferably contain at least one builder based on borate(s), such as, for example, orthoborate(s), and/or tetraborate(s), silicate(s), such as, for example, metasilicate(s), orthosilicate(s) and/or polysilicate(s), phosphate(s), such as, for example, orthophosphate(s), tripolyphosphate(s) and/or pyrophosphate(s), at least one alkaline medium based, for example, on potassium hydroxide solution, sodium hydroxide solution, sodium carbonate, sodium hydrogen carbonate, potassium carbonate and/or potassium bicarbonate, at least one amine, such as, for example, one based on monoalkylamine(s), trialkylamine(s), monoalkanolamine(s) and/or trialkanolamine(s), such as, for example, monoethanolamine, triethanolamine, methyl diethanolamine and/or at least one complexing agent, such as, for example, one based on carboxylate(s), such as, for example, gluconate and/or heptonate, sodium salt of nitrilotriacetic acid (NTA) and/or phosphonate(s), such as, for example, HEDP. The content of builders lies in particular either at 0 or in the range from 0.1 to 290 g/l or from 0.2 to 120 g/l, preferably at 0 or in the range from 0.5 or from 1 to 100 g/l or from 1.5 to 48 g/l, particularly preferably at 0 or in the range from 3 to 25 g/l. Mostly in this connection contents of builders are used in spraying processes in the range from 1 to 50 g/l and in dipping processes in the range from 2 to 100 g/l, usually irrespective of whether they are continuous or discontinuous processes.

In many variant embodiments it is advantageous if the bath contains at least one additive, such as, for example, a corrosion-inhibitor, and/or, if applicable, at least one additive is also added to the bath anew. As corrosion-inhibitors, for example, those based on alkylamidocarboxylic acid(s), aminocarboxylic acid(s), alkylhexane acid(s) and/or boric acid ester(s), in particular the amine salt(s) thereof, can be contained in the bath and/or be added to the bath. The content of corrosion-inhibitor(s) lies in particular at 0 or in the range from 0.01 to 10 g/l, preferably at 0 or in the range from 0.1 to 3 g/l, particularly preferably at 0 or in the range from 0.3 to 1 g/l. In addition, at least one additive, such as, for example, at least one biocide and/or at least one defoaming agent, can also be contained in the bath and/or be added to the bath, in particular in each case in the range from 0.01 to 0.5 g/l. Furthermore, the bath can also contain at least one pickling inhibitor and/or this can be added to the bath. Pickling inhibitors help to reduce or prevent the alkaline attack of the cleaner-bath, in particular in the case of surfaces of aluminium, magnesium, zinc and/or alloys thereof. They often act very selectively depending on the type of metallic surfaces to be protected so that these are used in part in certain mixes. The bath content of the pickling inhibitors then preferably lies at 0 or in the range from 0.01 to 10 g/l, particularly preferably in the range from 0.1 to 8 g/l. Inter alia borate(s), silicate(s) and/or phosphonate(s) can be used as the pickling inhibitor(s).

In the case of the method in accordance with the invention the anionic organic compounds, if applicable, contained in the bath and usually derived just from contaminants, in particular the anionic surfactants, are preferably made less water-soluble by means of a chemical reaction with at least one cationic organic compound and/or with multivalent cations. The insoluble compounds that develop in this connection preferably accumulate on the bath surface at least in part, in particular in the oil-containing phase, and can then be removed from the bath, if required. These surfactants are usually derived above all from the contaminants. The amphoteric surfactants and phosphate esters which are usually likewise only derived from the contaminants do not, however, as a rule react in this way chemically and as a rule remain contained unchanged and dissolved in the bath solution. Preferably none of these surfactants are added to the bath deliberately, since they can constitute a disturbance in particular when demulsifying and as a result of a great tendency to foam.

Mostly the total content of all the active ingredients in the bath without contaminants lies in the range from 0.5 to 300 g/l or from 1.2 to 150 g/l, preferably in the range from 2 to 50 g/l or 3 to 30 g/l, particularly preferably in the range from 4 to 20 g/l, from 5 to 15 g/l or from 5.5 to 12 g/l. In particular for cleaning car bodies, metal sheets and/or parts prior to phosphating it can lie in the case of spraying processes in particular in the range from 4 to 7 g/l and in the case of dipping processes in particular in the range from 7 to 30 g/l.

In the case of the method in accordance with the invention in many variant embodiments it is preferred in particular in the case of discontinuous operation of a cleaning process that no more than 10 g/l anionic organic compounds accumulate in the bath until there is maintenance of the bath, and it is particularly preferred to have no more than 5 g/l or no more than 3.5 g/l, especially preferably no more than 2 g/l anionic organic compounds in the bath.

In particular in the case of discontinuous cleaning processes it can be advantageous to determine the content of oil(s) and/or further contaminants, that is, in particular oil(s) and/or further non-polar organic compounds, in the bath before a suitable quantity of cationic organic compounds and further bath constituents, such as in particular builders, is added for bath-maintenance. In such systems which have been operated, for example, over 3 days to 8 weeks and in which the cleaning power is only low or very low and in which the bath hardly still or no longer demulsifies, but possibly already emulsifies, all of these contaminants are still largely contained in a distributed manner in the bath solution. Only by adding cationic organic compounds does there form over a few hours to over say 2 days a layer of oil(s) and non-polar organic compounds frequently say 1 to 15 cm thick on the bath surface as an oil-containing phase which can then be removed in a simple way, for example mechanically and/or by raising the bath level and allowing it to flow off. The quantity of cationic organic compounds that are to be added in this connection can be ascertained either by way of Epton titration, chromatographically or simply, precisely and effectively by repeated proportionate addition of cationic organic compounds in order to establish with the latter method after what quantity no mere substantial quantities of oil(s) and non-polar organic compounds are separated and float to the bath surface, that is, the bath no longer demulsifies.

In the case of continuously operating cleaning baths, on the other hand, when running in the system it usually suffices to determine the quantity of cationic organic compounds that is regularly required during the metering once.

In quite a few variant embodiments in the case of continuous operation it is particularly preferred to adjust the bath so that no or almost no unreacted, cationic organic compounds are contained in the bath. For as anionic organic compounds are taken up by the bath, the unreached cationic organic compounds that are found in the bath react with the anionic organic compounds. The terms "anionic organic compounds" and "cationic organic compounds" for the purposes of this application signify the corresponding unreacted compounds and not the adducts that develop therefrom.

In quite a few systems it can be enough to operate a cleaning zone (bath) or just a portion of the various cleaning zones (cleaning baths) in accordance with the invention, in particular if in this way the other cleaning zones are not loaded with contaminants to a greater extent.

The bath solution can in this case also be applied in at least one cleaning zone, for example by spraying and/or by spraying and brushing. In dipping, the at least one substrate can also, if applicable, be treated electrolytically, that is, by electrolytic cleaning. In particular these, although also other, variant processes are also suitable for strips.

The pressure that is applied during the cleaning processes in many cases lies substantially at atmospheric pressure if pressures during circulating processes, for example as a result of injection flooding processes (possibly up to say 50 bar), are disregarded, whilst in the case of spraying processes spraying pressures in the range from 0.1 to 5 bar are often worked with. The temperatures during the cleaning processes—partly as a function of the chemical composition—preferably lie in the range from 5 to 99° C., particularly preferably in the range from 10 to 95° C., with spraying processes often being applied in the range from 40 to 70° C. and dipping processes often being applied in the range from 40 to 95° C.

The non-ionic surfactants typically have an HLB value in the range from 5 to 12, often in the range from 6 to 12. Surfactants preferably act in a demulsifying manner at HLB values <10, in particular at those <9.

In the case of the method in accordance with the invention substrates in the form of metal sheets, coils (strips), wires, parts and/or composite components are preferably cleaned. Generally, the substrates which are cleaned in accordance with the invention preferably have metallic surfaces made from iron, steel, high-grade steel, zinc-coated steel, metallically coated steel, aluminium, magnesium, titanium and/or alloys thereof.

Surprisingly, despite decades of experience of many firms in the field of cleaning, success has been achieved in finding a new basic cleaning-process principle.

Surprisingly, cleaning processes and cleaner-compositions have been found in which even given a very high entry of contaminants a demulsifying operation has been able to be re-adjusted without any problems and in a simple manner.

Surprisingly, cleaning processes and cleaner-compositions have been found which it is possible to operate permanently with significantly lower contents of oil(s) including further contaminants than was usual or possible previously in the prior art with such contaminants and in which the initial high level of cleaning power can be permanently maintained, whereas it often continuously diminished in the case of the methods of the prior art unless membrane-filtration processes were used: for hitherto it was prior art for the cleaning baths currently used for cleaning metallic surfaces contaminated inter alia by oil(s) to have a content of oil(s) including further contaminants with a contamination of at least 0.7 g/l and frequently one in the range from 0.8 to 1.2 g/l, for example in automobile plants with bath-maintenance, and at least 1.5 g/l and frequently up to approximately 6 g/l of oil(s) including further contaminants, for example in automobile plants without bath maintenance, and yet even contents of up to say 20 g/l, for example, in general industrial plants without bath-maintenance. On the other hand, in the case of the methods in accordance with the invention it is quite possible in many embodiments to use the cleaning baths with a content of oil(s) including further contaminants with great contamination in the range from 0.05 to 1 g/l or from 0.1 to 2 g/l depending on the type of plant and utilization and frequently of the order of magnitude of say 0.5 g/l, for example in automobile plants with bath-maintenance, or of the order of magnitude of say 8 g/l of oil(s) including further contaminants, for example in general industrial plants without bath-maintenance. In the case of the methods in accordance with the invention it is frequently possible for them to be used with such low surfactant contents, such as in the range from 0.1 to 0.3 g/l or from 0.1 to 0.7 g/l. In the case of the methods in accordance with the invention the content of the cleaner-bath in terms of oil(s) including further contaminants can often be kept in the range from 0.05 to 1 g/l and/or the content of surfactants can often be kept in the range from 0.05 to 0.5 g/l, whilst in the case of typical cleaning processes of the prior art the content of the cleaner-bath in terms of oil(s) including further contaminants often lies in the range from 0.7 to 6 g/l and/or the content of surfactants lies in the range from 0.3 to 1.5 g/l.

It is therefore frequently possible to operate the bath in methods in accordance with the invention with a significantly lower consumption of surfactants and other bath constituents than was previously possible, in which case an extension of the useful bath lives can also often result many times over or even by several years. In this connection, the chemical oxygen demand (COD value) of the waste water from the rinsing zones is also often significantly reduced, which is why the waste-water cleaning can be significantly simplified and configured less expensively. In this connection, often the entry of oils, fats, soaps and further contaminating substances into the pretreatment zone, such as, for example, the phosphating zone, for example of an automobile plant, is also significantly reduced, and as a result the quality of the pretreatment process and the pretreatment layer is significantly improved and evened out.

Surprisingly, cleaning processes and cleaner-compositions have been found in which during continuous operation it is possible to dispense with the use of expensive membrane-filtration processes for bath-maintenance with costly ultrafiltration systems or microfiltration systems that possibly necessitate investment costs of 1 to 2 million €. In this connection, it is possible, if applicable, to switch over to the use of oil-separators, for which usually investment costs of the order of magnitude of only say 10 to 80 thousand € are incurred. As a result of the replacement or abandonment of a membrane-filtration system, savings can be made to a considerable extent in terms of personnel.

Surprisingly, cleaning processes and cleaner-compositions have been found which are comparatively simple to apply and the consumption costs of which depending on the starting conditions, as a result of the hitherto unnecessary addition of cationic organic compounds, are slightly higher or in consequence of failing consumption of chemical substances on account of increased cleaning power necessitate consumption costs at say the same or even a lower level than before. Nevertheless, in the case of quite a few larger systems yearly costs of the order of magnitude of say 100,000 € can possibly be saved.

In the case of continuous systems with oil-separators with the use of the cleaning process with a cleaner-composition in accordance with the invention often a low content of oil(s) including further contaminants is permanently attained without special expenditure in comparison with methods in accordance with the prior art, in particular because this content can often be lowered by say a factor of 2 as a result of the use of the addition of cationic organic compounds.

In the case of discontinuous systems with the use of the cleaning process with a cleaner-composition in accordance with the invention in the case of great contamination often the bath is not exchanged (no expensive disposal of the bath), but instead the corresponding quantity of cationic organic compounds is added to the aqueous alkaline cleaner-composition containing at least one non-ionic surfactant in accordance with the invention so that the oil and other contaminants demulsify and is scooped off as an oil-containing phase. The quality of the oil thus obtained is often so high that in many cases it can even be exploited thermally (burnt), in particular if the water content lies say below 20% by weight instead of as otherwise at approximately 30 to 50% by weight. As a result, considerable cost-savings and simplifications are possible in comparison with cleaning processes in accordance with the prior art.

The substrates that are cleaned in accordance with the method with the cleaner-compositions in accordance with the invention can be used for phosphating, in particular for alkali-phosphating, such as, for example, for iron-phosphating, for manganese-phosphating or for zinc-phosphating, and/or for coating with at least one treatment or pretreatment composition based on silane/siloxane/polysiloxane, titanium/zirconium compound, iron oxide/cobalt oxide, chromate, oxalate, phosphonate/phosphate and/or organic polymer/copolymer and/for for coating with at least one composition based on a substantially organic polymeric composition with a welding primer, with a galvanic coating, with an enamel coating, with an anodization, with a CVD coating, with a PVD coating and/or with a temporary corrosion-protection coating.

EXAMPLES IN ACCORDANCE WITH THE INVENTION AND COMPARATIVE EXAMPLES

The invention is explained in greater detail in the following by way of selected exemplary embodiments, without being limited thereto.

In preliminary tests in the laboratory a number of different kinds of surfactants acting in a demulsifying manner, predominantly non-ionic surfactants based on ethoxylated alkyl alcohols with one end-group closure per alkyl group, were tested for their cleaning power, for their demulsifying action and for their tendency to foam. At the same time, in these preliminary tests in the laboratory various cationic surfactants acting in a demulsifying manner were tested for their demulsifying action and for the tendency to foam. All of the non-ionic surfactants acting in a demulsifying manner based on ethoxylated alkyl alcohols with one end-group closure per alkyl group tested here proved to have a demulsifying action to a somewhat greater or somewhat less extent, yet also showed small, but clear differences from molecule to molecule in the cleaning power and in the tendency to foam. Nevertheless, all of these pre-selected and tested non-ionic surfactants acting in a demulsifying manner based on ethoxylated alkyl alcohols with one end-group closure per alkyl group were particularly well suited in comparison with the plurality of further surfactants that could possibly be used.

Afterwards, the most suitable non-ionic surfactant acting in a demulsifying manner based on ethoxylated alkyl alcohols with one end-group closure was used together with the most suitable cationic surfactant acting in a demulsifying manner in an industrial phosphating plant in continuous operation. The former belongs to the non-ionic surfactants acting in a demulsifying manner in accordance with the invention.

In this industrial phosphating plant with subsequent lacquering for large-sized components the cleaning zones before phosphating consist of two zones: 1. alkaline dip-degreasing and 2. alkaline spray-degreasing. Substantially the same aqueous cleaner-composition is used in both degreasing baths.

Before the change-over to an optimized method with a non-ionic surfactant acting in a demulsifying manner in accordance with the invention and with a cationic surfactant in accordance with the invention, during continuous operation over three to seven weeks contents of oil(s) including further contaminants set in in these baths of more than 3 g/l per bath, in particular in the dip-degreasing bath, with these contents possibly reaching 10 g/l. Over this time, the baths admittedly had cleaner-framework and a non-ionic surfactant acting in a demulsifying manner metered and subsequently metered into them without the addition of further surfactants, but were not completely renewed. However, other surfactants were also introduced as a result of the cleaning away of the components that were to be cleaned. The subsequent metering was necessary on account of cleaner-constituents being discharged from the baths. With oil contents of the order of magnitude of say 5 g/l of oil(s) upwards including further contaminants the cleaning power gradually diminished and resulted in insufficient degreasing and uneven formation of the phosphate layer subsequently applied. The required high quality of lacquer could therefore no longer be achieved with the necessary degree of certainty. The cleaning baths did not contain any additions of cationic surfactants acting in a demulsifying manner that had been added deliberately and that did not derive, if applicable, from the contamination of the baths.

Then there was added to the cleaning bath, based on a neutral-cleaner formulation, inter alia a non-ionic surfactant in accordance with the invention acting in a demulsifying manner and based on ethoxylated non-propoxylated alkyl alcohols with an alkyl group with on average 9.5 to 12.5 carbon atoms, with on average 7.5 to 14.5 EO groups and with one end-group closure. The non-ionic surfactant in accordance with the invention used and acting in a demulsifying manner proved to be exceptionally suitable with respect to its strong cleaning power, its high-level demulsifying action and its low tendency to foam. In addition, as a result of the change-over of the operation of the cleaning zones to bath compositions, the further non-polar organic contaminants and/or anionic organic compounds following the occurrence of a content of oil(s) including further contaminants, such as, for example, fats, in the bath in the range from 2.5 to 4 g/l oil(s) including the further contaminants with an addition of a cationic surfactant in accordance with the invention acting in a demulsifying manner as a quaternary ammonium compound according to the general formula (I) with one benzyl group, the respective useful bath life depending on the operating performance could be doubled, in part even at least quadrupled, until the whole bath was exchanged and as a result renewed. In addition, as a result of the addition of this cationic surfactant acting in a demulsifying manner, the oil including the further contaminants had to a large extent built up on the surface of the bath as an oil-rich phase including fats and further non-polar organic contaminants. The oil-rich phase contained only 2 to 30% by weight aqueous phase, including builders and surfactants, as well as in fact 70 to 98% by weight substantially oil(s) and further constituents of the oil-containing phase. The oil-rich phase could then be scooped off, for example, after one day. After the oil-rich phase had been scooped off, the bath had say still 0.5 to 1 g/l oil(s) including the further contaminants. In this connection, after the separation of the oil-rich phase the at least one non-ionic surfactant in accordance with the invention acting in a demulsifying manner basically contained in the bath composition had to be subsequently metered in anew, since these surfactants had been removed in part with the oil-rich phase. On the other hand, the cationic surfactant acting in a demulsifying manner was not immediately subsequently metered in, but only when the contents of oil(s) including further contaminants had set in in the bath again at 2.5 to 4 g/l after several weeks. This cationic surfactant had been specially selected in accordance with the conditions for the demulsifying operation and was a quaternary ammonium compound of the general formula (I) with one benzyl group.

The combination of the two surfactants in accordance with the invention acting in a demulsifying manner proved to be excellent. In this system, neither the process parameters of the cleaning zones, nor the concentrations of the cleaning compositions substantially also already used hitherto had to be changed to a comparatively great extent.

In this connection, it was also possible to renew the second degreasing bath first after a longer period of use (for example after 6 months) than the first degreasing bath (for example after 4 months), which captures the contaminants to a significantly greater extent than the second degreasing bath.

As a result of the operation in accordance with the invention the surfactant concentration of the cleaning baths no longer needed to be increased in the case of very high contents of oil(s) and/or further contaminants, and the consumption of chemicals dropped a little as a result, yet above all as a result of the renewal of the baths at significantly longer intervals. Since the change-over of the operation of the cleaning baths, no impairment during the phosphating and lacquering occurred any more that could be attributed to the cleaning. The costs of disposal of the cleaning baths dropped drastically, because the disposal cycles were clearly extended and because no greatly loaded cleaning baths needed to be disposed of any more. In addition, the proportion of the subsequent work required after at least one lacquering, for example as a result of polishing by hand, and in many cases thereafter also as a result of renewed phosphating and lacquering, had as a result been substantially lowered, this likewise helping to make savings with respect to high process costs.

The invention claimed is:

1. An aqueous alkaline cleaner-composition for cleaning metallic surfaces comprising:

a non-ionic surfactant that acts in a demulsifying manner, wherein the non-ionic surfactant that acts in a demulsifying manner is based on ethoxylated alkyl alcohols with one or two alkyl groups with on average in each case 7.5 to 16.5 carbon atoms and with on average 5.5 to 18.5 ethylene oxide groups per alkyl group, with one or two end-group closures, of which at least one end-group closure is benzyl, wherein the surfactant is not propoxylated, a cationic organic compound comprising a cationic polymer, wherein the cationic polymer comprises at least five units of a monomer building block, and each building block contains at least one nitrogen-containing heterocyclic positively charged group with 5 or 6 ring atoms, and wherein the aqueous alkaline cleaner-composition is in contact with a contaminant which comprises an oil.

2. An aqueous alkaline cleaner-composition according to claim 1, further comprising at least one member selected from the group consisting of a further non-ionic surfactant, an amphiphilic surfactant, a cleaner-framework, and a corrosion-inhibitor.

3. An aqueous alkaline cleaner-composition according to claim 2, further comprising at least one ethoxylated-propoxylated non-ionic surfactant with a cloud point below 20° C.

4. An aqueous alkaline cleaner-composition according to claim 2, wherein the at least one cationic organic compound is present in the cleaner-composition in roughly or at least such a content as is necessary for extensive or complete chemical reaction thereof with the non-polar organic compounds or anionic organic compounds present in the cleaner-composition.

5. An aqueous alkaline cleaner-composition according to claim 2, wherein the contents of the at least one non-ionic surfactant and the at least one cationic organic compound are selected so that the cleaner-composition operates in the weakly anionic, weakly cationic or charge-neutral range.

6. An aqueous alkaline cleaner-composition according to claim 2, wherein the contaminant further comprises an anionic organic compound, wherein the content of the cationic organic compound and the anionic organic compound are in a bath in a quantity directly prior to the chemical reaction thereof in which the stoichiometric ratio of the cationic surfactant or the cationic polymer to anionic organic compounds in the bath is kept in the range from 0.1:1 to 10:1.

7. An aqueous alkaline cleaner-composition according to claim 2, which is in a bath, wherein the total content of all the active ingredients in the bath without contaminants is in the range from 0.5 to 300 g/l.

8. An aqueous alkaline cleaner-composition according to claim 1, further comprising at least one ethoxylated-propoxylated non-ionic surfactant with a cloud point below 20° C.

9. An aqueous alkaline cleaner-composition according to claim 1, which is in a bath and the contaminant further comprises anionic organic compounds, wherein the content of cationic organic compounds is in a quantity directly prior to the chemical reaction thereof in which the stoichiometric ratio of cationic organic compounds to anionic organic compounds in the bath is kept in the range from 0.1:1 to 10:1.

10. An aqueous alkaline cleaner-composition according to claim 9, wherein the bath is in discontinuous operation.

11. An aqueous alkaline cleaner-composition according to claim 9, wherein the content of anionic organic compounds in the bath is determined by Epton titration.

12. An aqueous alkaline cleaner-composition according to claim 1, wherein the total content of all the active ingredients is in the range from 0.5 to 300 g/l, not including any contaminant.

13. An aqueous concentrate of the aqueous alkaline cleaner-composition according to claim 1, wherein the at least one non-ionic surfactant is present in a concentration higher by a factor of 5 to 5,000 compared to the aqueous alkaline cleaner-composition.

14. An aqueous alkaline cleaner-composition according to claim 1, wherein the contaminant comprises non-polar organic compounds or anionic organic compounds, and wherein the cationic organic compound is present in the cleaner-composition in roughly or at least such a content as is necessary for extensive or complete chemical reaction thereof with non-polar organic compounds or anionic organic compounds.

15. An aqueous alkaline cleaner-composition according to claim 1, wherein the contaminant comprises a metal drawing aid.

16. An aqueous alkaline cleaner-composition according to claim 1, wherein the oil is present in an amount of less than 3 g/l.

17. An aqueous alkaline cleaner-composition according to claim 1, wherein the oil is a processing oil.

18. An aqueous alkaline cleaner-composition as in claim 1 wherein the composition provides a demulsifying state in a bath wherein the demulsifying state is identified by spontaneous separation of an oil-containing phase with diminished or a lack of bath movement, while with certain or strong movement of the cleaner-composition no oil-containing phase separates.

19. An aqueous alkaline cleaner-composition according to claim 1, wherein the building block contains a benzyl group.

* * * * *